US007213420B2

(12) United States Patent
Lynch et al.

(10) Patent No.: US 7,213,420 B2
(45) Date of Patent: May 8, 2007

(54) SOCK

(75) Inventors: Justin Lynch, Mullingar (IE); Maria Bourke, Mullingar (IE); Andrew Thompson, Mullingar (IE)

(73) Assignee: Legend Care I.P. Limited, Dublin (IE)

( * ) Notice: Subject to any disclaimer, the term of this patent is extended or adjusted under 35 U.S.C. 154(b) by 264 days.

(21) Appl. No.: 10/290,369

(22) Filed: Nov. 8, 2002

(65) Prior Publication Data

US 2003/0089136 A1 May 15, 2003

Related U.S. Application Data

(60) Provisional application No. 60/331,169, filed on Nov. 9, 2001, provisional application No. 60/331,170, filed on Nov. 9, 2001, provisional application No. 60/331,171, filed on Nov. 9, 2001, provisional application No. 60/331,172, filed on Nov. 9, 2001, provisional application No. 60/400,048, filed on Aug. 2, 2002.

(51) Int. Cl.
*D04B 9/46* (2006.01)

(52) U.S. Cl. ..... 66/186

(58) Field of Classification Search ..... 66/178 R, 66/179–188; 2/239, 240
See application file for complete search history.

(56) References Cited

U.S. PATENT DOCUMENTS

| | | | | |
|---|---|---|---|---|
| 245,294 | A | 8/1881 | Handy | |
| 3,601,818 | A | 8/1971 | Chesebro | 2/239 |
| 3,796,067 | A | 3/1974 | East | 66/178 |
| 3,995,322 | A | 12/1976 | Chesebro, Jr. | 2/239 |
| 4,397,161 | A | 8/1983 | Chesebro, Jr. | 66/178 |
| 4,571,960 | A | 2/1986 | Hursh et al. | 66/196 |
| 4,615,188 | A | 10/1986 | Hursh et al. | 66/196 |
| 4,726,497 | A | 2/1988 | Glaze | 223/60 |
| 4,843,844 | A | 7/1989 | Hursh et al. | 66/196 |
| 4,958,507 | A | 9/1990 | Allaire et al. | 66/19 |
| 5,095,548 | A | 3/1992 | Chesebro, Jr. | 2/239 |
| 5,533,365 | A | 7/1996 | Sangiacomo | 66/145 |
| 5,570,591 | A | 11/1996 | Frullini et al. | 66/58 |
| 5,575,012 | A | 11/1996 | Fox et al. | 2/239 |
| 5,590,420 | A | 1/1997 | Gunn | 2/69 |
| 5,606,876 | A | 3/1997 | Sangiacomo | 66/148 |
| 5,675,992 | A | 10/1997 | Wrightenberry | 66/178 |
| 5,737,943 | A | 4/1998 | Bernhardt | 66/178 |

(Continued)

FOREIGN PATENT DOCUMENTS

| | | |
|---|---|---|
| EP | 0105773 | 4/1984 |

(Continued)

*Primary Examiner*—Danny Worrell
(74) *Attorney, Agent, or Firm*—Jacobson Holman PLLC

(57) ABSTRACT

A knitted sock has an inner layer 2 comprising a toe end 4 and an outer layer 3 comprising a toe end 7. The inner and outer toe ends are aligned and joined wale stitch to wale stitch to form a composite toe end, which is closed to provide a flat toe seam 10. The layered sock is manufactured complete in a single process being knit continuously from the inner toe end to the outer toe end. It comprises reciprocated heel and toe portions. The foot portion of the inner layer is knit from a yarn with properties such as a low coefficient of friction and/or antifungal/antibacterial properties. The low friction fiber is a fluoropolymer such as polytetrafluroethylene. The outer layer may comprise a cushion structure.

56 Claims, 18 Drawing Sheets

U.S. PATENT DOCUMENTS

| | | | | |
|---|---|---|---|---|
| 5,752,278 | A | 5/1998 | Gunn | 2/69 |
| 5,778,702 | A | 7/1998 | Wrightenberry | 66/178 |
| 5,814,003 | A | 9/1998 | Knox et al. | 602/63 |
| 5,829,057 | A | 11/1998 | Gunn | 2/69 |
| 5,832,539 | A | 11/1998 | Williams | 2/239 |
| 5,899,096 | A | 5/1999 | Sangiacomo | 66/221 |
| 5,918,317 | A | 7/1999 | Bernhardt | 2/239 |
| 5,960,645 | A | 10/1999 | Sangiacomo | 66/13 |
| 6,061,829 | A | 5/2000 | Gunn | 2/69 |
| 6,108,820 | A | 8/2000 | Bernhardt | 2/239 |
| 6,109,069 | A | 8/2000 | Sangiacomo | 66/133 |
| 6,139,929 | A | 10/2000 | Hayton et al. | 428/35 |
| 6,143,368 | A | 11/2000 | Gunn | 427/407 |
| 6,155,081 | A | 12/2000 | Frullini et al. | 66/58 |
| 6,158,251 | A | 12/2000 | Sangiacomo | 66/78 |
| 6,158,253 | A | 12/2000 | Svoboda et al. | 66/178 |
| 6,158,254 | A | 12/2000 | Richard | 66/179 |
| 6,189,345 | B1 | 2/2001 | Sangiacomo | 66/134 |
| 6,205,821 | B1 | 3/2001 | Sangiacomo | 66/38 |
| 6,209,363 | B1 | 4/2001 | Jordan | 66/215 |
| 6,212,912 | B1 | 4/2001 | Sangiacomo | 66/40 |
| 6,286,343 | B1 | 9/2001 | Sangiacomo | 66/217 |
| 6,289,701 | B1 | 9/2001 | Hasenack | 66/202 |
| 6,292,951 | B1 | 9/2001 | Kalde | 2/239 |
| 6,334,222 | B1 | 1/2002 | Sun | 2/239 |
| 6,341,505 | B1 | 1/2002 | Dahlgren | 66/185 |
| 6,354,144 | B1 | 3/2002 | Hirota et al. | 73/61 |
| 6,415,449 | B2 | 7/2002 | Duplock | 2/275 |
| 6,446,267 | B1 | 9/2002 | Shah | 2/239 |
| 6,457,332 | B1 | 10/2002 | Schiavello | 66/8 |
| 2002/0040588 | A1 | 4/2002 | Kalde | 66/182 |
| 2002/0088254 | A1 | 7/2002 | Singleton | 66/177 |
| 2002/0095716 | A1 | 7/2002 | Solwey | 2/239 |
| 2002/0108405 | A1 | 8/2002 | Yakopson | 66/177 |

FOREIGN PATENT DOCUMENTS

| | | |
|---|---|---|
| EP | 0582769 | 5/1996 |
| EP | 0751719 | 5/2000 |
| FR | 2784550 | 4/2000 |
| FR | 2785299 | 5/2000 |
| JP | 1040602 | 2/1989 |
| JP | 7148004 | 6/1995 |
| JP | 9291402 | 11/1997 |
| JP | 9316704 | 12/1997 |
| JP | 11012802 | 1/1999 |
| JP | 11050303 | 2/1999 |
| JP | 11107004 | 4/1999 |
| JP | 11217704 | 8/1999 |
| WO | WO01/11998 | 2/2001 |
| WO | WO02/35950 | 5/2002 |

51
59
60
51
60
53

51
57
60
85
53

60
58
85
53

57
88
58
60
85
53

86
85
53
60

Fig. 26(a)
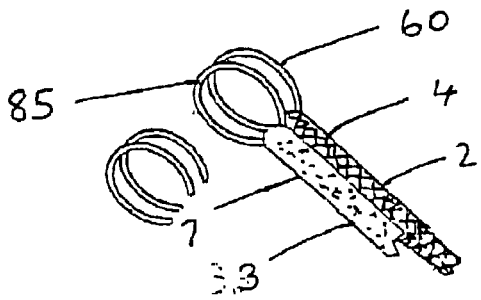
Fig 26(b)
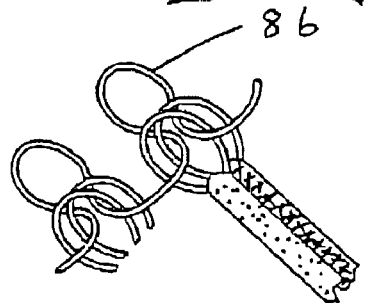
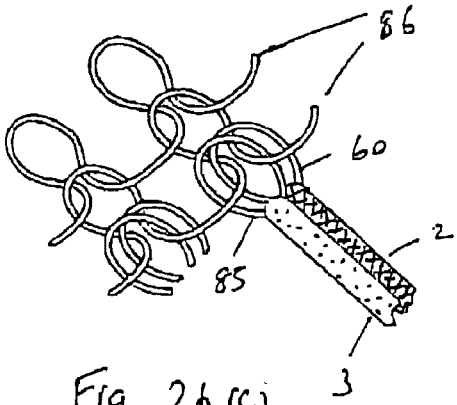
Fig. 26 (c)
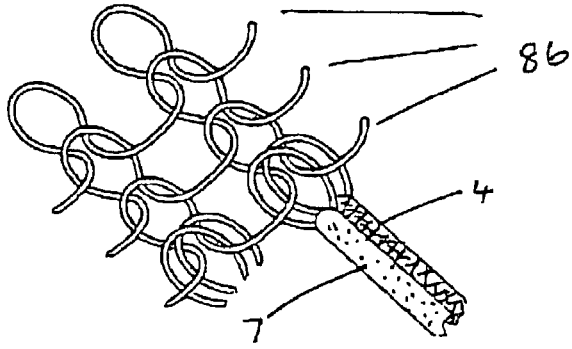
Fig. 26 (d)

SOCK

This is a complete application claiming benefit of provisionals 60/331,169, filed Nov. 9, 2001, 60/331,170, filed Nov. 9, 2001, 60/331,171, filed Nov. 9, 2001, 60/331,172, filed Nov. 9, 2001, and 60/400,048, filed Aug. 2, 2002.

INTRODUCTION

The invention relates to socks and in particular to socks having more than one layer or ply.

Socks with more than one layer in theory provide improved properties of durability, performance and comfort for a user. However, there are serious drawbacks with available layered socks. Conventional double layer socks are closed at the toe by sewing the toe of the inner layer closed and then sewing the toe of the outer layer closed with the result that the inner layer and outer layer are not connected. This leads to bunching, twisting and other causes of discomfort to the wearer. Alternatively, the inner and outer toes are closed together by manually aligning the knitting wales of the two layers to avoid the undesired twisting. However, this increases the amount of manual operator time and results in a bulky seam which can cause wearer discomfort. In particular, such socks are wholly unsuitable for use by people with ailments which place them at high risk of recurring serious foot complaints and complications.

Conventional layered socks are comprised of layers where each layer has the weight and bulk typical of a comparable single layer sock. This gives an overall weight, bulkiness and constrictiveness which makes such layered socks wholly unsuitable for use by people with ailments which place them at higher risk callus and blister formation, and other types of skin breakdown can lead to of recurring serious foot complaints and complications.

In the manufacture and knitting of socks, it is known to combine a low friction fiber, for example a fluropolymeric fiber, with terry cushion in the foot portion of a sock. However, when the low friction fiber is knit into the terry loops with a conventional yarn such as cotton, wool or polyester, the conventional yarn loops will always stand proud (i.e. the loops will be longer) of the loops of the low friction fiber. This is due to the dynamics of terry loop formation on circular knitting machines running at production knitting speed when a combination of relative tensions and knitting forces causes yarn already knitted into loops to be 'robbed back' in the opposite direction.

Under the dynamic conditions of loop formation, when a low friction fiber is knitted into the terry cushion loops alongside the conventional main body yarn such as cotton, wool or polyester, the low friction yarn will be 'robbed back' more than the conventional yarn because it has virtually no elasticity compared with all the conventional yams used to make socks. The lower the elasticity of the yarn the greater will be the robbing back dynamic which is virtually impossible to control accurately in a production setting.

One object of the invention is thus to provide an improved double layer sock and a method for producing such a double layer sock which will address at least some of these problems.

The invention also relates to a sock for use in preventing or reducing the occurrence of callus formation, blisters, irritations, and other types of skin breakdown which are caused by a combination of friction and pressure, aggravated by the presence of heat (frictional and ambient) and moisture on the surface of the foot. Callus formation, blisters and other types of skin breakdown can lead to ulceration, which if not healed, can result in amputation in people afflicted with certain autoimmune diseases and disorders such as diabetes, eczemza, lupus; collagen and skin inflammatory disorders; circulatory problems, geriatric needs, obesity and other ailments or conditions which place them at a higher risk of recurring foot complications caused by even moderate friction and pressure levels, even in properly fitted footwear.

Diabetes is by far the most serious prevalent condition which requires ongoing preventive foot care, currently affecting 6% to 7% of the population in first world countries with the prevalence rate forecast to double over the next 20 years. It is a chronic life-long condition which, if not carefully managed, can lead to various serious short and long-term complications. It is also a progressive condition in that the longer one lives with diabetes the greater the risk of developing the long term complications associated with the condition.

The progressive effect of nerve disease and vascular disease on the lower extremities leave patients with Type 2 diabetes at risk of developing serious foot complications which can lead to amputation. An estimated 60–70% of patients with diabetes have mild to severe forms of nerve disease (neuropathy). Clinical studies have shown that callus formation is the main portal for ulceration and infection in the diabetic foot. Serious foot complications are the single greatest reason for hospitalisation of diabetics. There are an estimated 55,000 lower leg amputations in the US each year directly attributable to diabetic related foot complications and research has shown that over 50% of these could be avoided through preventive foot care. It has been estimated that the total annual cost of diabetic foot disease in the US is more than $1billion, excluding surgeons fees, rehabilitation costs, prostheses, time lost from work and disability. Clinical research has shown that prevention of foot complications is crucial because there is a high recurrence rate for patients who have experienced ulceration, even where preventive care measures have been in place and adhered to.

Blisters, calluses, irritations and inflammation on the foot surface are primarily caused by frictional forces at the interface of the foot and the inner surface of the sock. Friction studies have shown that blisters result from forces that mechanically separate epidermal cells at the level of the stratum spinosum and hydrostatic pressure causes the area of the separation to fill with a fluid similar in composition to plasma. The magnitude of the frictional forces, (which are a function of the coefficient of friction of each of the surfaces at the interface, the pressure applied at the contact area and the amount of heat and moisture present) and the number of times that the sock surface cycles across the foot surface, combine to determine the probability of callus and/or blister development (assuming skin condition is a constant).

Conventional preventive footcare socks, most of which are of single sock construction, attempt to provide a degree of protection. However, none of the available socks adequately address the problem.

Another object of the invention is therefore to provide a sock which will assist in reducing or preventing callus and blister formation in people with diabetes and other ailments. Calluses and blisters may be exacerbated by opportunistic infections. These conditions place diabetics and others with reduced circulatory ability or skin disorders at risk of serious foot complications.

There are about 250,000 sweat glands in the foot, a higher concentration than in any other area of the body. The combination of perspiration, a warm enclosed environment and the presence of bacteria results in the unpleasant smell commonly referred to as foot odour. Bacteria act on fatty deposits, ammonia and denatured proteins in perspiration to create foot odour. The problem is exacerbated by non-breathable shoe component materials, particularly foot-wear such as trainers or sneakers. Shoes which are not allowed to dry out between wear can absorb foot odour and will host odour causing bacteria and fungi.

Two of the most common preventable footcare conditions are athletes foot and foot odour. It is estimated that between 12% and 15% of the population experience either or both of these conditions periodically or on a recurring basis.

Athletes foot is a fungal infection caused by the *T.Mengatrophytes* fungus. It is a most uncomfortable condition with the most common symptoms being intense itching combined with cracked and peeling skin between the toes but can infect any part of the foot and toe nails. The infected skin has a white and soggy appearance and can become inflamed and bleeding can occur in severe cases. Both shoes and hosiery may retain fungal spores, making effective treatment more difficult. Bacteria may thrive as a secondary infection which worsens the symptoms of the condition and makes it more difficult to cure. It is very contagious and is commonly contracted by walking in bare feet on moist or wet floors such at swimming pools or shared changing or bathroom facilities. It can also spread by sharing shoes, hosiery and other personal care items. Athletes foot is also much more common in people who tend to have moist feet.

There are a host of medications, lotions and powder treatments available for the treatment of both foot odour and athletes foot. In recent years, there has been a growing emphasis on prevention of both conditions through preventive foot care. One of the developments in the manufacture of hosiery products has been the increasing use of yarns which have been treated with anti-microbial and anti-fungal chemical agents which are intended to inhibit fungal and microbial development. However there is growing consumer concern about the safety of the chemical agents used in the treatment of these products and most treated yams have the added weakness of reduced effectiveness after repeat washing.

It is known to treat such conditions using a yarn comprising a layer of pure silver permanently bonded to the surface of a Nylon fiber. The yarn is available under the trade mark X-static from Noble Fiber Technologies of Scranton, USA. The yarn has been used in the bio-medical sector several years. In recent years, the yarn has been knitted into conventional single ply sock products. However, none of the available socks optimally apply the yarn in the prevention of foot odour and athletes foot.

Another object of the invention is thus to provide an improved sock which will address at least some of these problems.

STATEMENTS OF INVENTION

According to one aspect the invention provides:

a layered sock comprising:— an inner sock layer having a welt end and a toe end;

an outer sock layer having a welt end and a toe end;

the welt ends of the layers being contiguous; and the toe ends of the sock being joined to form a linked substantially flat toe seam.

According to the invention there is provided a knitted sock comprising:

an inner sock layer having an inner toe end;

an outer sock layer having an outer toe end;

the inner toe end and the outer toe end being joined to form a single composite toe end;

the single composite toe end being closed to provide a substantially flat toe seam.

In a preferred embodiment the inner sock layer comprises a heel portion, a toe portion and a sole portion and the heel portion, toe portion and sole portion are of the same yarn composition.

Preferably the inner sock layer comprises a reciprocated heel portion.

In one embodiment the outer sock layer comprises a heel portion, a toe portion and a sole portion.

The outer sock layer may comprise a reciprocated heel portion.

In one embodiment the heel portion, toe portion and sole portion of the outer sock layer is of a different yarn composition to the yarn composition of the heel portion, toe portion and sole portion of the inner sock layer.

The inner toe end and the outer toe end are joined substantially stitch for stitch.

The inner toe end and the outer toe end may be joined by a knitting yarn such as a polyamide yarn, for example a Nylon yarn.

In one embodiment the composite toe end comprises a number of courses of yarn.

Preferably the yarn of the composite toe end is the same as that of the outer toe.

The composite toe end may comprise at least two courses of yarn.

In one embodiment the single composite toe end is closed by joining opposite sides of the single composite toe end substantially stitch for stitch.

The single composite toe end may be closed by a knitting yarn such as a polyamide yarn, for example a Nylon yarn.

In one embodiment the toe seam is recessed with respect to the main body of the inner sock layer.

The toe seam has a thickness that is less than the thickness of main body of the inner sock layer adjacent the seam.

In one embodiment the sock is a two layer sock comprising the inner sock layer and the outer sock layer, the inner and outer sock layers having welt ends, and the welt ends are contiguous.

Preferably at least a portion of the inner sock layer is at least partially knit from at least one technical yarn.

The technical yarn may be unplated.

The technical yarn may be plated, for example with another technical yarn.

In a preferred embodiment a technical yarn comprises a blend of fibers.

Alternatively a technical yarn is corespun with an elastomeric yarn.

In one case a technical yarn has low friction properties.

In another case a technical yarn has antibacterial properties.

A technical yarn may have antifungal properties.

In one embodiment a technical yarn comprises a low friction fiber. The low friction fiber may comprise a fluropolymeric fiber such as a polytetrafluroethylene fiber.

In one embodiment a technical yarn is a composite yarn comprising a first fiber having a low coefficient of friction and a second fiber having a higher coefficient of friction than that of the first fiber.

The first fiber may comprise a fluropolymeric fiber such as a polytetrafluroethylene fiber.

The second fiber may be a polyester fiber, a polypropylene fiber or a polyamide fiber.

In one case a technical yarn comprises a blend of a polytetraflouroethylene fiber and a polyester fiber.

In another embodiment a technical yarn comprises coated Nylon fiber. The Nylon fiber may be coated with silver.

In one embodiment the portion of the inner sock layer which is at least partially knit from at least one technical yarn is one or more of an ankle portion, a heel portion, a sole portion and a toe portion.

The portion of the inner sock layer which is at least partially knit from at least one technical yarn may comprise an ankle portion, a heel portion, a sole portion, and a toe portion.

A technical yarn may be of a hydrophobic material.

In one embodiment the inner layer comprises a leg portion.

The leg portion of the inner layer may be of an unrestrictive construction.

The leg portion of the inner layer may be of a polyamide fiber such as a Nylon fiber.

In one embodiment the outer layer comprises a foot portion and a leg portion.

At least the foot portion of the outer layer may be of a cushion structure.

At least the foot portion of the outer layer may be of a terry structure.

At least the foot portion of the outer layer may be of a hydrophilic material.

In one embodiment the leg portion of the outer layer is of relaxed construction.

Alternatively the leg portion of the outer layer is of restrictive construction.

In one embodiment at least portion of the outer layer of the sock comprises a technical yarn.

A technical yarn in this case may be a fiber having antifungal and/or antibacterial properties.

The fiber may be a coated Nylon such as Nylon coated with silver.

In another aspect the invention provides a knitted sock comprising:— an inner sock layer; and an outer sock layer, the inner sock layer having a foot portion that is knit from a composite yarn comprising a first fiber having a low coefficient of friction and a second fiber having a higher coefficient of friction than that of the first fiber.

The first fiber preferably comprises a fluropolymeric fiber such as a polytetrafluroethylene fiber.

The second fiber may be a polyester fiber, a polyproplylene fiber or a polyamide fiber.

In one embodiment the foot portion of the inner layer comprises a heel portion, a toe portion and a sole portion and the heel portion, toe portion and sole portion are knit from the same composite yarn.

Preferably the inner sock layer comprises a reciprocated heel portion.

In one embodiment the inner sock layer comprises a leg portion of unrestrictive construction.

The leg portion of the inner sock layer may be of a different fiber to that of the foot portion.

The leg portion of the inner sock layer may be of a polyamide fiber such as a Nylon fiber.

Preferably the outer sock layer comprises a foot portion which preferably comprises a heel portion, a toe portion and a sole portion. The outer sock layer preferably comprises a reciprocated heel portion.

In one embodiment the foot portion of the outer layer is of a cushion structure.

The foot portion of the outer sock layer may be of terry structure.

The foot portion of the outer layer is preferably of a hydrophilic material.

The outer layer may comprise a leg portion.

The leg portion of the outer layer may be of relaxed construction.

Alternatively the leg portion of the outer layer is of restrictive construction.

In one embodiment at least a portion of the outer layer incorporates at least one technical yarn.

A technical yarn in this case may be a fiber having antifungal and/or antibacterial properties, such as a coated Nylon, for example a silver coated Nylon.

In another aspect the invention provides a method for producing a layered sock on a circular knitting machine comprising a dial having dial elements and a cylinder having cylinder elements, the sock comprising an inner layer and an outer layer and the method comprising the steps of:

knitting an internal toe pouch with an internal toe connected to the dial elements;

knitting an inner foot portion;

knitting an inner leg portion;

knitting an external leg portion;

knitting an external foot portion;

forming an external toe connected to the cylinder elements;

transferring the internal toe from the dial elements to the cylinder elements;

joining the internal toe to the external toe to form a composite toe; and closing the composite toe with a substantially flat seam.

The internal toe and the external toe are preferably aligned substantially stitch for stitch.

The composite toe is preferably closed automatically such as by a toe closing unit.

In one embodiment the method comprises the step of automatically transferring the sock from the knitting machine to the toe closing unit; and discharging a completed double layer sock from the toe closing unit.

The knitting machine preferably has control means to control stitch density and patterning.

The stitches of a preparation course of the internal toe may be engaged onto the dial elements and the inner and outer layers of the sock are knit while said inner layer preparation course remain on the dial elements.

The invention also provides a double layer sock formed on a circular knitting machine having means to control stitch density, patterning and terry structure, a dial plate having dial elements and an automatic toe closing unit with the inner layer fabric comprising a low friction yarn, by the method comprising:

engaging stitches of the preparation courses of said inner layer of said sock onto the dial elements of a dial on said knitting machine;

while said inner layer preparation courses remain on the dial elements, knitting the inner layer toe, foot, heel and ankle in a low friction fluoropolymer yarn and having reciprocated heel and toe pouches, the remainder of the leg section of the said inner layer being constructed using other yarns;

while said inner layer preparation remains on the dial elements, knitting the outer layer sock that is continuous of the inner layer sock in other yarns and stitch formations, cushion terry fabric incorporated in the foot area, again with reciprocated heel and toe pouches;

disengaging said inner layer preparation courses from said dial elements connecting said inner layer to the said outer layer;

automatically closing the outer layer toe; and discharging said sock from the knitting machine complete.

In another aspect the invention provides a layered sock comprising an inner sock layer and an outer sock layer, the inner sock layer having a foot portion comprising a heel portion, a toe portion and a sole portion, the foot portion being knit from an unplated fluropolymeric fiber.

The fiber may be a polytetrafluoroethylene fiber.

In one embodiment the inner layer comprises a leg portion.

The leg portion may be of a Nylon fiber.

The outer sock layer may comprise a foot portion having a heel portion, a toe portion and a sole portion.

The heel portion of the outer sock layer is preferably a reciprocated heel portion.

The outer layer may comprise a foot portion of a cushion structure.

The foot portion of the outer layer may be of a terry structure.

In one embodiment the inner sock layer comprises an inner toe end and the outer sock layer comprises an outer toe end.

Preferably the inner and outer toe ends are joined substantially stitch for stitch.

The inner toe end and the outer toe end may be joined stitch for stitch by a knitting yarn.

The knitting yarn may be a polyamide such as a Nylon.

Preferably the inner and outer toe ends are joined to form a substantially flat toe seam.

At least portion of the outer layer of the sock may be knit from a fiber having antifungal and/or antibacterial properties.

In a further aspect the invention provides a knitted sock having an inner sock layer and an outer sock layer, the inner sock layer having a foot portion comprising a heel portion, a toe portion and a sole portion, the foot portion being knit from a fiber having antifungal and/or antibacterial properties.

The fiber may be a coated Nylon fiber such as a silver coated Nylon fiber.

The fiber may be unplated.

In one embodiment the inner layer comprises a leg portion.

The leg portion of the inner layer may be of a different fiber than that of the foot portion.

The inner sock layer may comprise an inner toe end and the outer sock layer comprises an outer toe end.

The inner and outer toe ends are preferably joined substantially stitch for stitch.

The inner toe end and the outer toe end may be joined stitch for stitch by a knitting yarn such as a Nylon.

The inner and outer toe ends are preferably joined to form a substantially flat toe seam.

The sock of the invention is a layered sock especially a double layer which is manufactured complete in a single process and incorporates a flat seam joining the two (as opposed to four) layers of fabric. This guarantees wale stitch to wale stitch alignment of both socks making up the final double sock which in turn gives perfect alignment of the double structure, something which cannot be guaranteed in most other double socks available requiring manual alignment of the wales and manual operated toe seaming.

The single process manufacture of the double sock allows the knitting of the inner sock in single, unplated, yarns. This allows maximum flexibility in the yarn composition and structure of the two sock layers while at the same time minimises the overall bulk and weight of the double layer structure a problem with most existing double layer socks manufactured using conventional methods.

Knitting of a foot portion of an inner sock in a 1×1 stitch, unplated construction from a low friction fiber creates a smoothly constructed, low friction fiber interface to both the foot and the inner surface of the outer sock.

The invention provides a low friction inner sock composed of an unplated low friction fiber with the outer and inner sock layers joined at the welt end and toe seam. The toe seam is stitch linked automatically, giving a flat linked seam.

In particular, the invention provides a double layer sock in which the foot portion of the inner layer sock comprises an unplated, low friction fluoropolymer yarn such as the PTFE fiber Teflon (from DuPont). The outer layer sock may be of a cotton, plated with Nylon/lycra construction with the foot area comprised of the heel, toe and sole being made with a sandwich terry fabric. Both the outer sock structure and the material used to make the outer sock can be changed to meet varied performance requirements. For example, cotton could be substituted by wool or a wool variant such as smartwool to make a sock with better thermal properties for winter conditions. Similarly, the structure of the outer sock could be varied, for example by changing the area size and location of terry cushion to provide cushion protection over a greater or lesser area of the foot and/or leg.

The sock inner layer is knit in a tubular fashion after firstly attaching itself to the dial elements of a circular knitting machine. The inner heel and toe are knitted in a reciprocated fashion. The knitting continues with the outer layer of the sock being joined to the inner layer via an elasticated welt. When the outer layer toe has finished knitting, the dial discharges itself back onto the cylinder needles, completely connecting the inner and outer layers wale stitch to wale stitch, beginning to end. An automatic toe closing unit is then engaged, automatically closing the outer toe, again stitch to stitch. The double layer sock is discharged from the knitting machine complete ready for boarding and packing.

An improved double layer sock is achieved without the need of manually closing the toe end. This gives a superior seam where only 2 layers of fabric are flat linked together with the flattest part of the seam being on the inside of the double sock.

BRIEF DESCRIPTION OF THE DRAWINGS

The invention will be more clearly understood from the following description thereof with reference to the accompanying drawings, in which:

FIG. 10(*b*) is a corresponding detailed view of single loops of each of the inner and outer layers of a sock;

FIG. 11(*b*) is a corresponding detailed view of single loops of each of the inner and outer layers of a sock;

FIG. 20 is a perspective view of a dial loop on a dial jack;

FIGS. 26 (*a*), (*b*), (*c*) and (*d*) are views of steps in joining the inner and outer layers of a sock;

FIGS. 27 to 29 are perspective views illustrating the transfer of the open toe portions to a Lintoe attachment;

DETAILED DESCRIPTION

Figure 3:
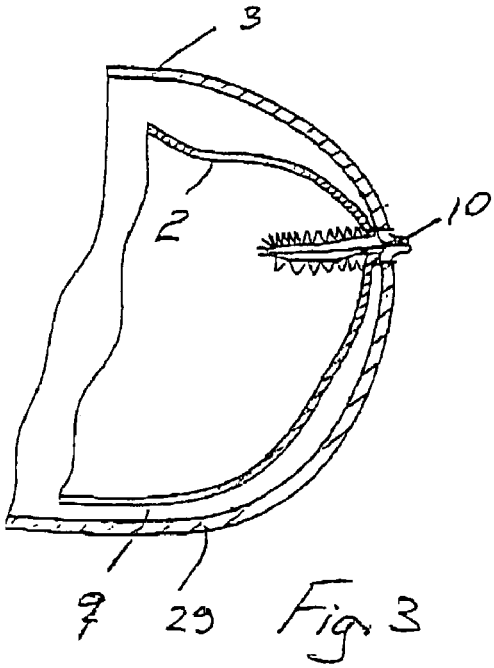
FIG. 3 is a cross sectional view of a toe seam detail of the sock.
Figure 1:
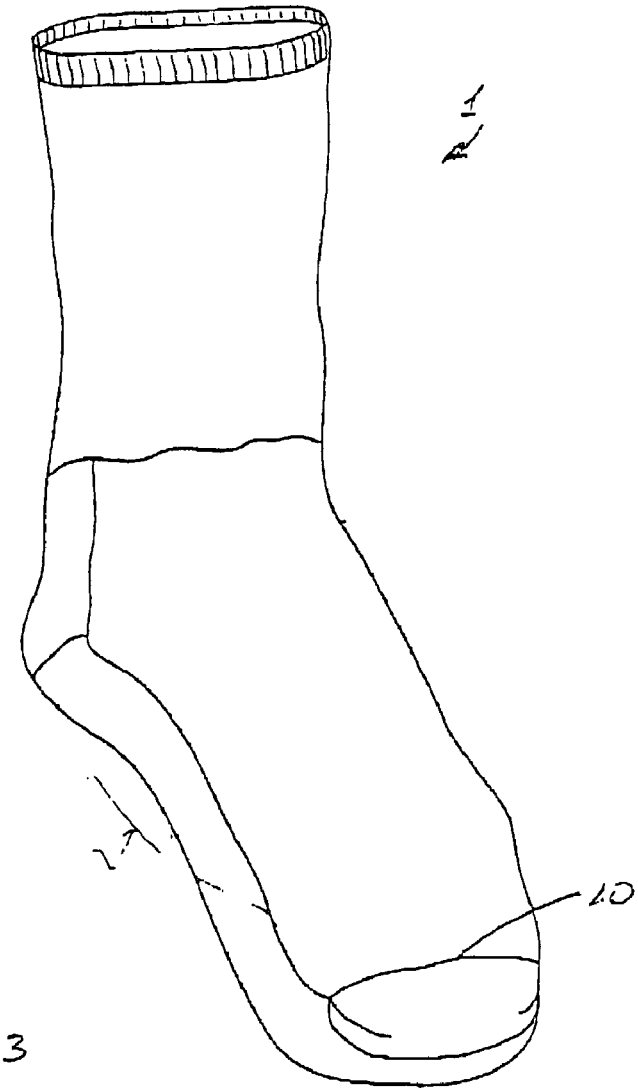
FIG. 1 is a perspective view of a double layer sock according to the invention.
Figure 2:
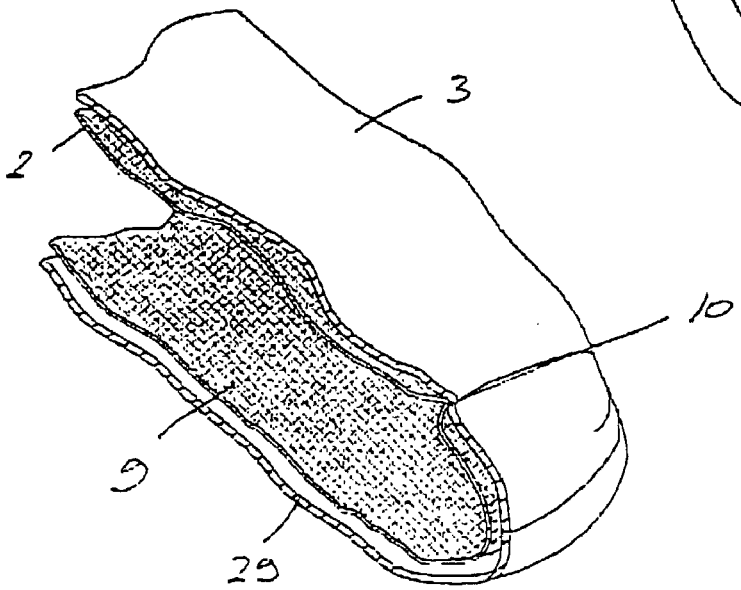
FIG. 2 is a cut-away cross sectional view of a foot portion of the sock of FIG. 1.
Figure 5:
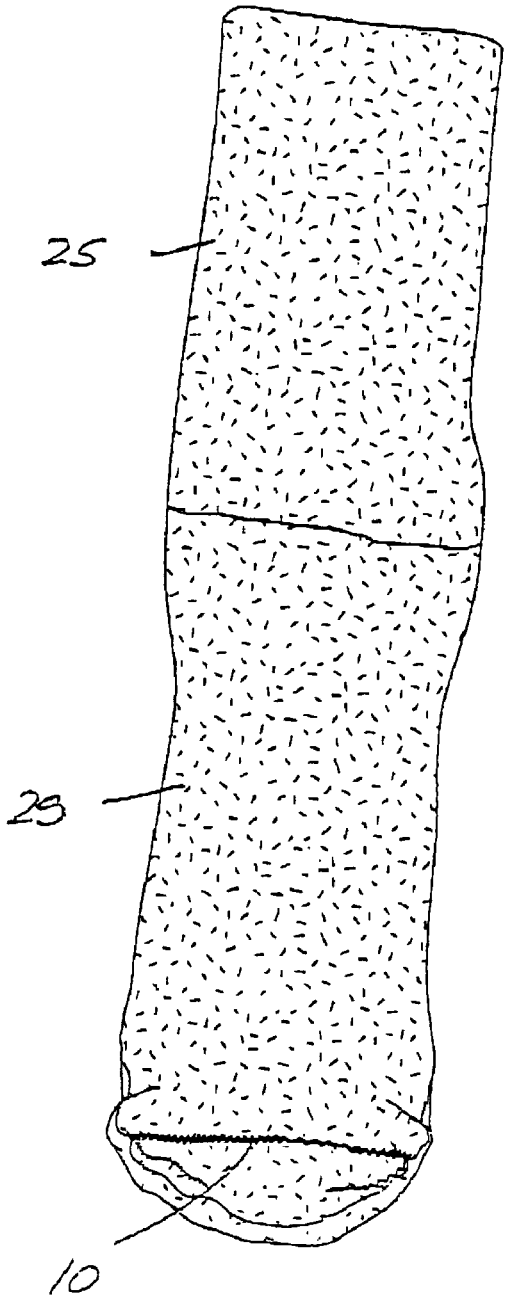
FIG. 5 is a front view of an outer layer of the sock.
Figure 4:
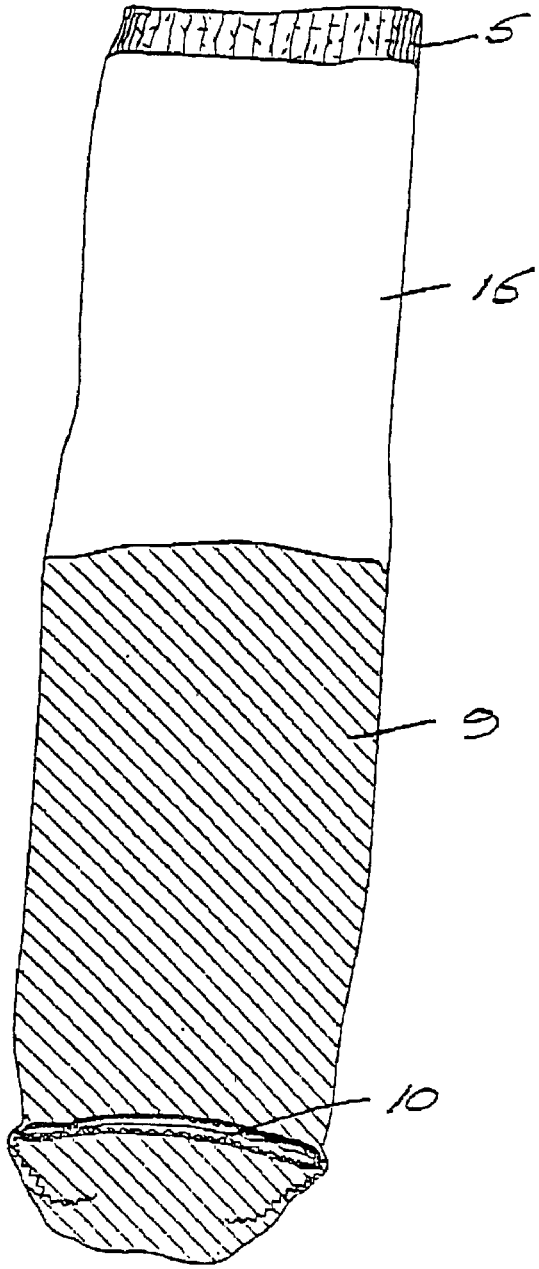
FIG. 4 is a front view of an inner layer of the sock.
Figures 6, 7:
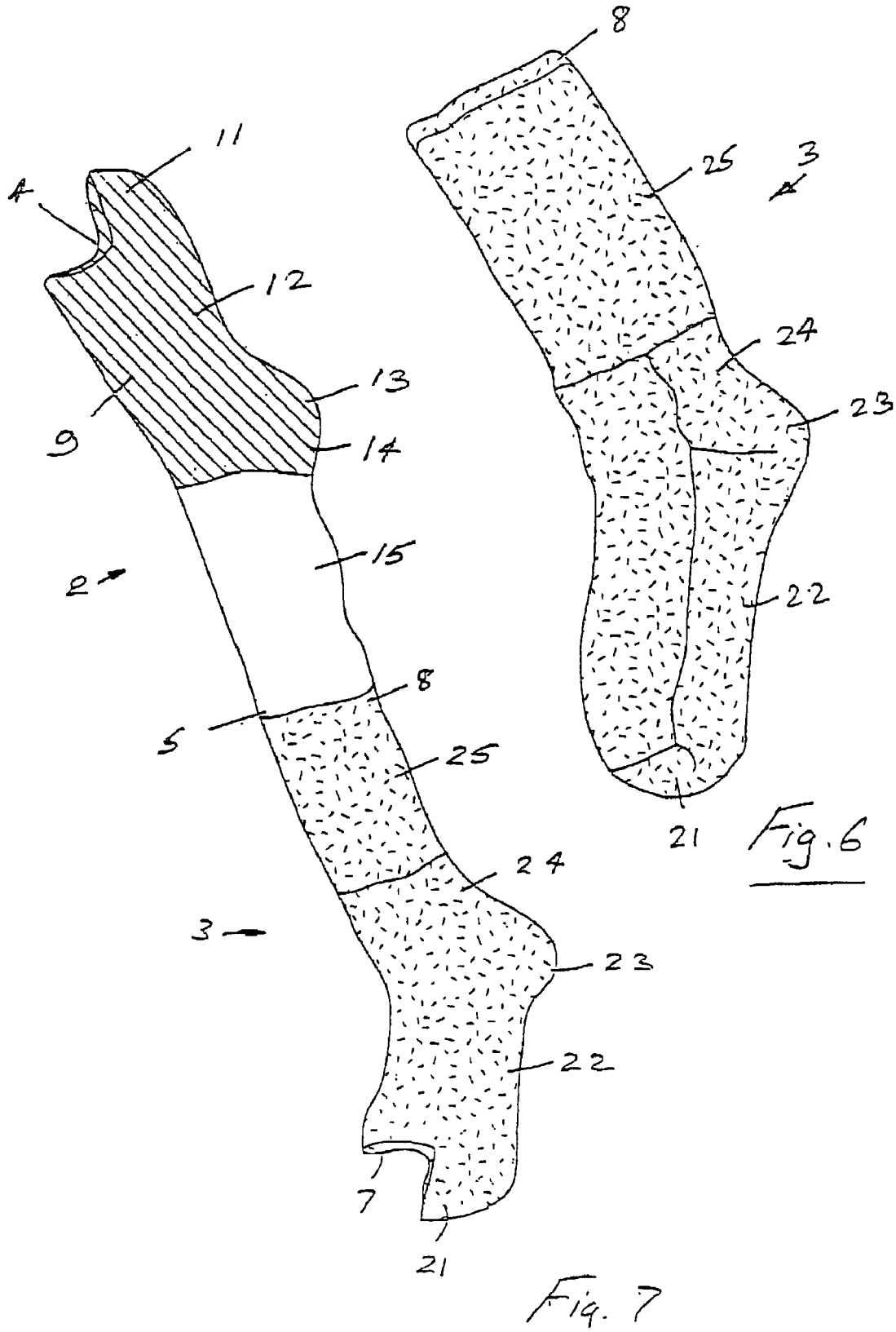
FIG. 6 is a side view of the sock.
FIG. 7 is a view of the inner and outer layers of the sock prior to joining at a toe.
Figure 8:
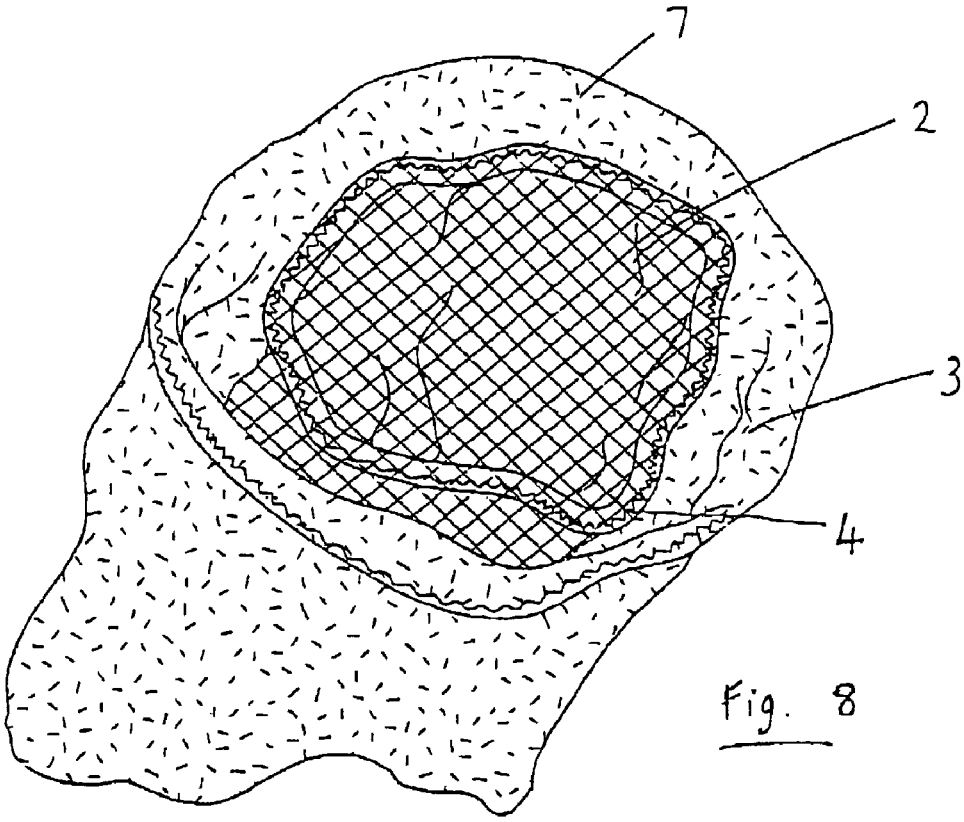
FIG. 8 is a perspective view of the inner and outer layers of the sock prior to joining at a toe.
Figure 9:
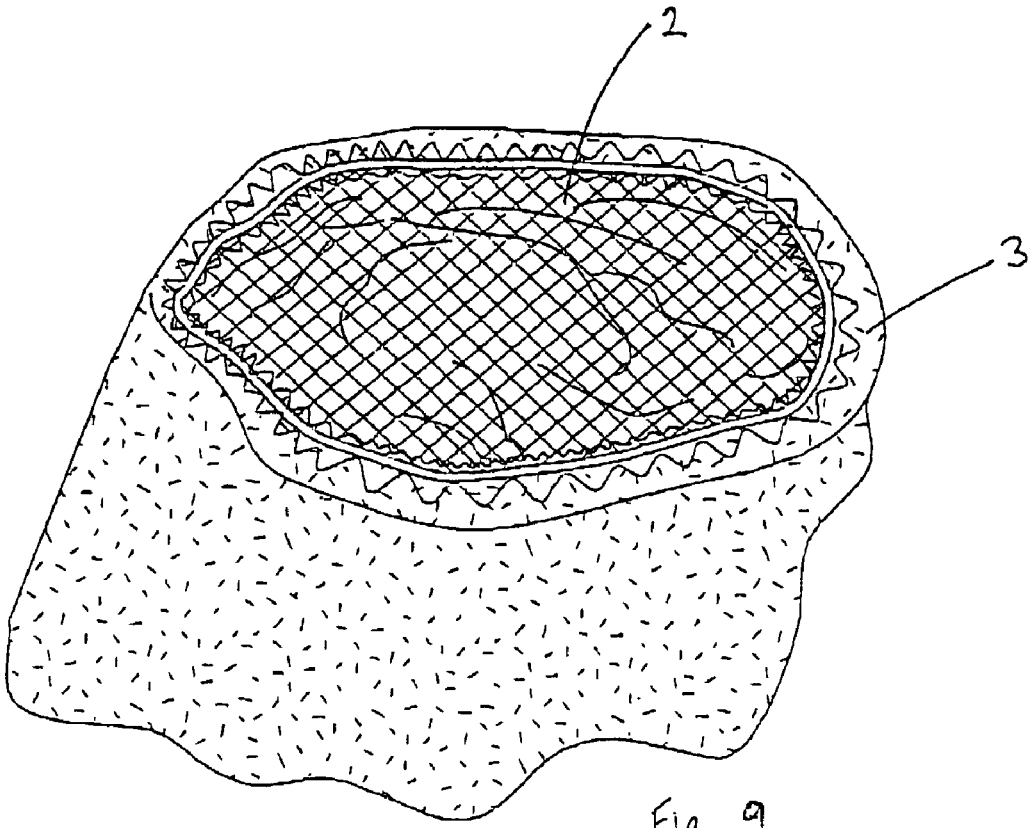
FIG. 9 is a view of the inner and outer layers of the sock joined at a toe prior to closing of the toe seam.
Figure 10A:
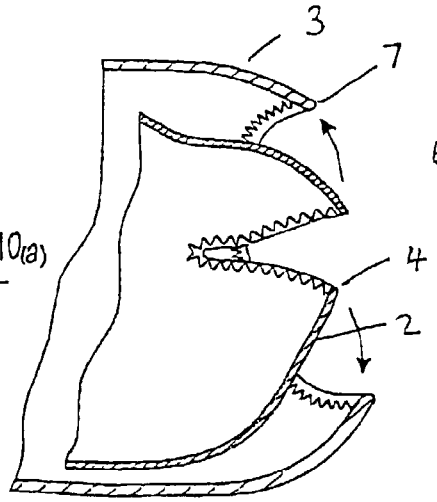
FIG. 10(*a*) is a view of the inner and outer layers of a sock prior to joining.
Figure 10B:
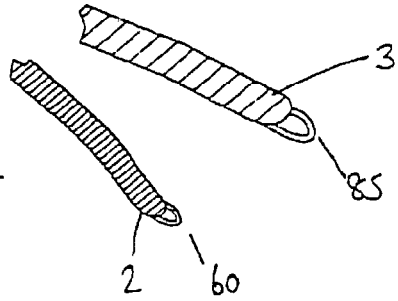
Figure 11B:
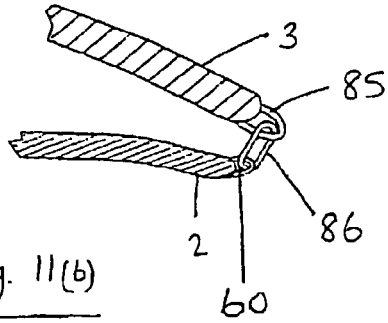
FIG. 11(*a*) is a view of the inner and outer layers of a sock after they have been joined but prior to closing of a toe seam.
Figure 11A:
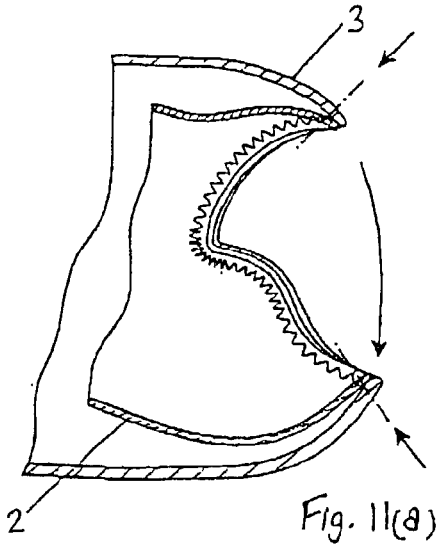

Referring to the drawings and initially to FIGS. 1 to 14 thereof there is illustrated a layered sock 1 according to the invention comprising an inner layer 2 and an outer layer 3. The inner layer 2 has an inner toe end 4 and a welt region 5. The outer layer 3 has an outer toe end 7 and a welt region 8. In this case the sock is a double layer sock and the welt regions 5, 8 of the sock are contiguous while the toe ends 4, 7 are separately formed, on knitting as will be described in detail below. The inner and outer toe ends 4, 7 are joined by a substantially flat toe seam 10. The completed sock 1 has only one seam, namely the toe seam 10.

The inner layer 2 comprises an internal foot portion 9 having a toe pouch 11, an internal sole 12, an internal heel which in this case is a reciprocated heel 13 and an internal ankle 14. In this case the internal foot portion 9 is knit from a technical yarn which adheres technical properties such as anti-friction and/or antimicrobial/antifungal properties. The foot portion 9 may be knit from a 100% unplated low friction yarn, preferably a fluropolymer, especially a polytetrafluroethylene yarn such as a Teflon yarn from Du Pont. Alternatively the foot portion 9 may be knit from a composite yarn comprised of a blend of a PTFE fiber and another fiber. One such fiber is Teflon SY from Du Pont which comprises 50% PTFE and 50% Dacron fiber. Another technical fiber is antimicrobial/antifungal fiber such as a silver coated Nylon available under the name X-static.

Importantly, this yarn preferably does not have a plating structure. A plating structure contains loops composed of two or more yarns often with different physical properties each having been separately supplied through its own guide to the needle hook in order to influence its respective position relative to the surface (technical or outer face) of the fabric. The plating (or backing yarn) is the yarn that lies on the inside surface of the finished knitted fabric. The most common application of plating is to reinforce the structure of the finished fabric but can also be employed creatively to achieve a number of surface design effects. The yarn used on at least portion of the internal foot portion of the sock of the invention is unplated.

The inner layer 2 also comprises a leg portion 15 and the internal welt 5. The leg portion 15 may be of a material different from that of the foot portion. For example, the leg portion 15 may be of a Nylon such as a Tactel Nylon. The internal welt 15 may be of elasticated construction, for example from a mixture of cotton, Nylon and elastic yarn. Such a welt structure is not essential on the internal layer.

The outer layer 3 generally also comprises an external foot portion 29 having a toe pouch 21, an external sole 22, an external heel 23, and an external ankle 24. The external foot may be knit from any suitable cushion material such as a terry cotton. A leg part 25 and the welt portion 8 of the external layer 3 may be of the same material as the corresponding parts of the internal layer.

Figure 12A:
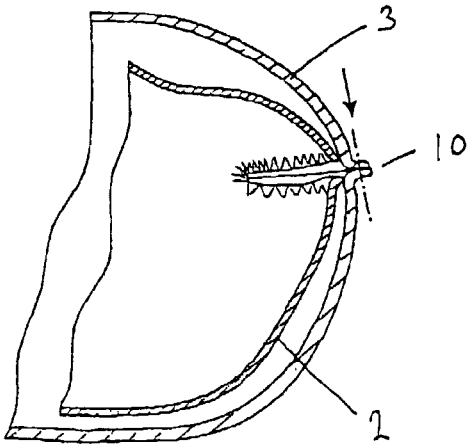
FIG. 12(*a*) is a cross-sectional view of a closed toe seam and FIG. 12(*b*) is a corresponding detailed view of single loops of each of two inner and outer layers of a sock.
Figure 12B:
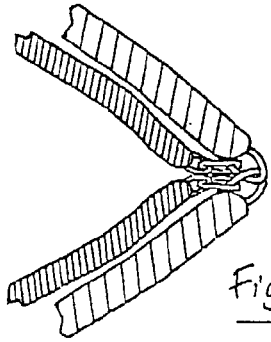
Figure 13:
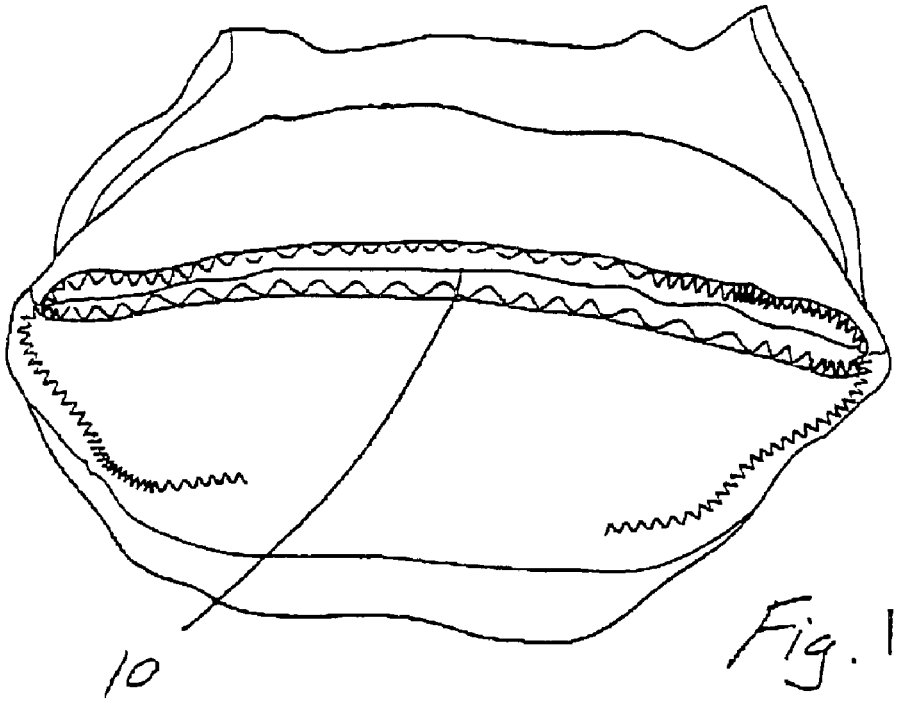
FIG. 13 is an enlarged view of the inside of a toe seam of the sock.
Figure 14:
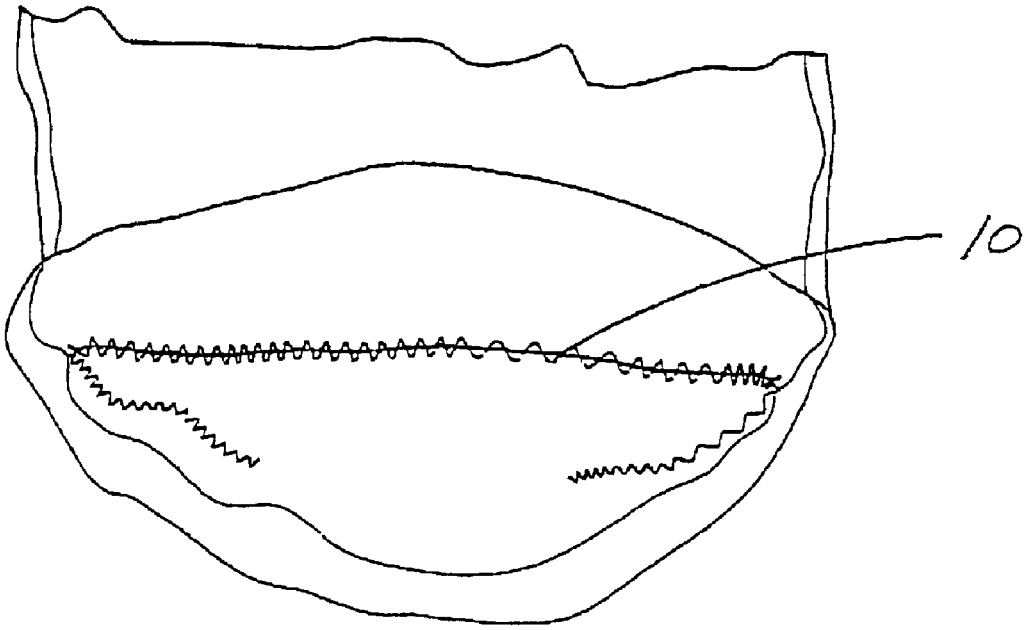
FIG. 14 is an enlarged view of the outside of a toe seam of the sock.

The outer toe end and inner toe end are joined together to form a joined composite toe end as illustrated in FIGS. 8 to 11. A closed toe seam 10 is illustrated in FIGS. 12 to 14.

A completed double layer sock of the invention comprises a tubular outer layer with a reciprocated heel and toe and a tubular inner layer which is made from a low friction fluoropolymer yarn with a reciprocated heel and toe, connected inside by the elasticated double welt. The double layer sock has an elasticated welt that is continuous with the leg portion that is continuous with a cushion terry high heel structure that is continuous with a cushion terry reciprocated heel which in turn is continuous with a cushion terry foot portion this is continuous with the cushion terry toe which is continuous with the cushion terry reciprocated toe that is closed by an automatic toe closing unit resulting in a 100% flat linked seam.

Referring to FIGS. 15 to 32 the double layer sock of the invention may be knit on a Sangiacomo cylinder knitting machine fitted with a Lintoe toe closing machine. The cylinder knitting machine comprises a dial 50 with dial elements 51 and a cylinder 52 with cylinder needles 53. The Lintoe automatic closing machine comprises a transfer unit 55 and a toe closing unit 56.

A preparation of two courses of fabric is knitted consisting for example of Nylon and elastic by means of a 1×1 needle selection at the main feed. This allows the dial, which is positioned concentrically adjacent the upper end of the needle cylinder and contains a number of dial elements with hooks that are positioned evenly around the periphery of it, to rotate radially with the cylinder to extend the dial elements by means of a retractable pneumatic cylinder.

This allows the dial elements to pass between the 1×1 needle selection and form loops 60 now connecting the cylinder fabric with the dial fabric.

Figure 15:
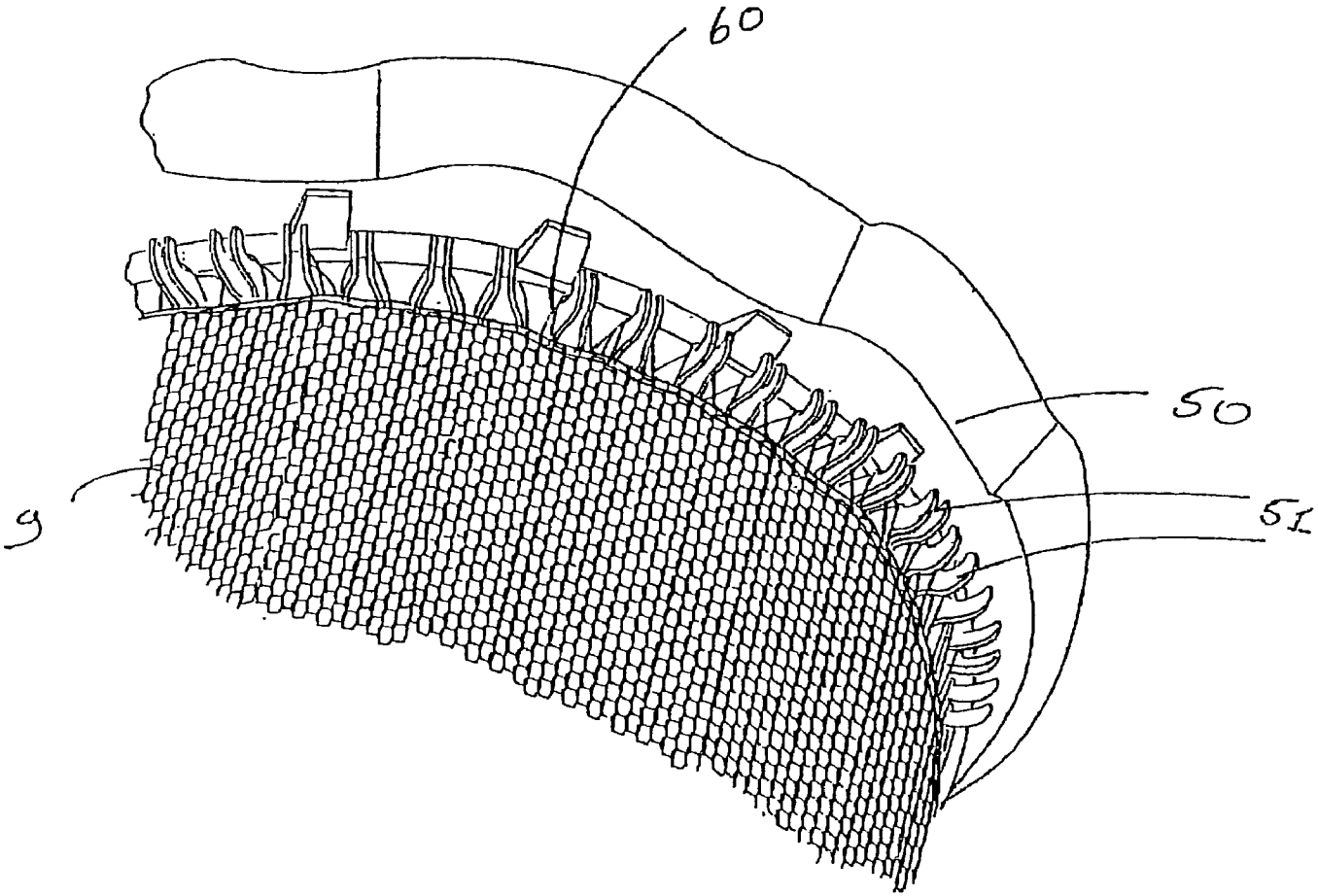
FIG. 15 is a perspective view of part of an inner foot portion of the sock mounted on the dial elements of a cylindrical knitting machine.
Figure 16:
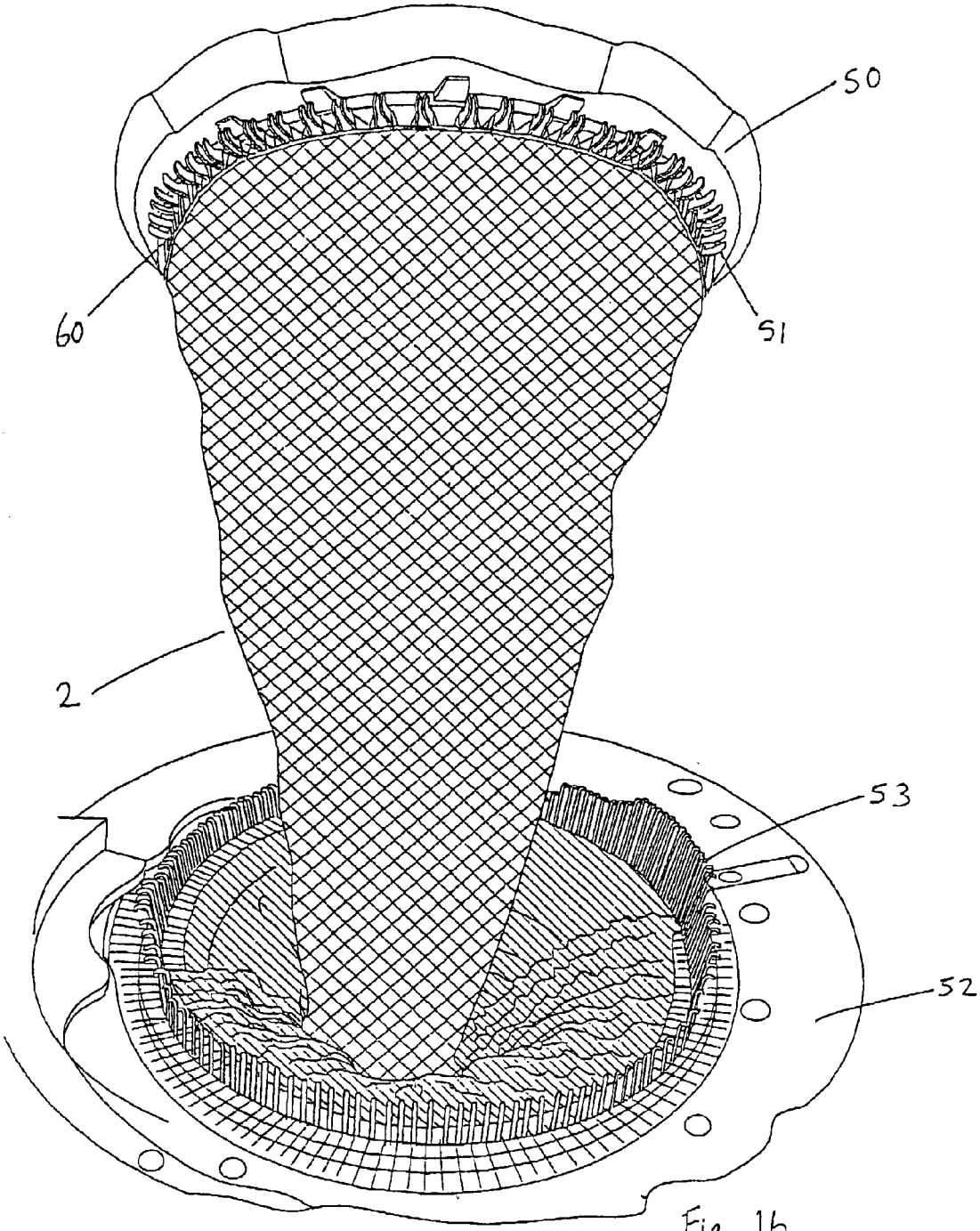
FIG. 16 is a perspective view of the inner foot portion being knit on a cylindrical knitting machine.
Figure 17:
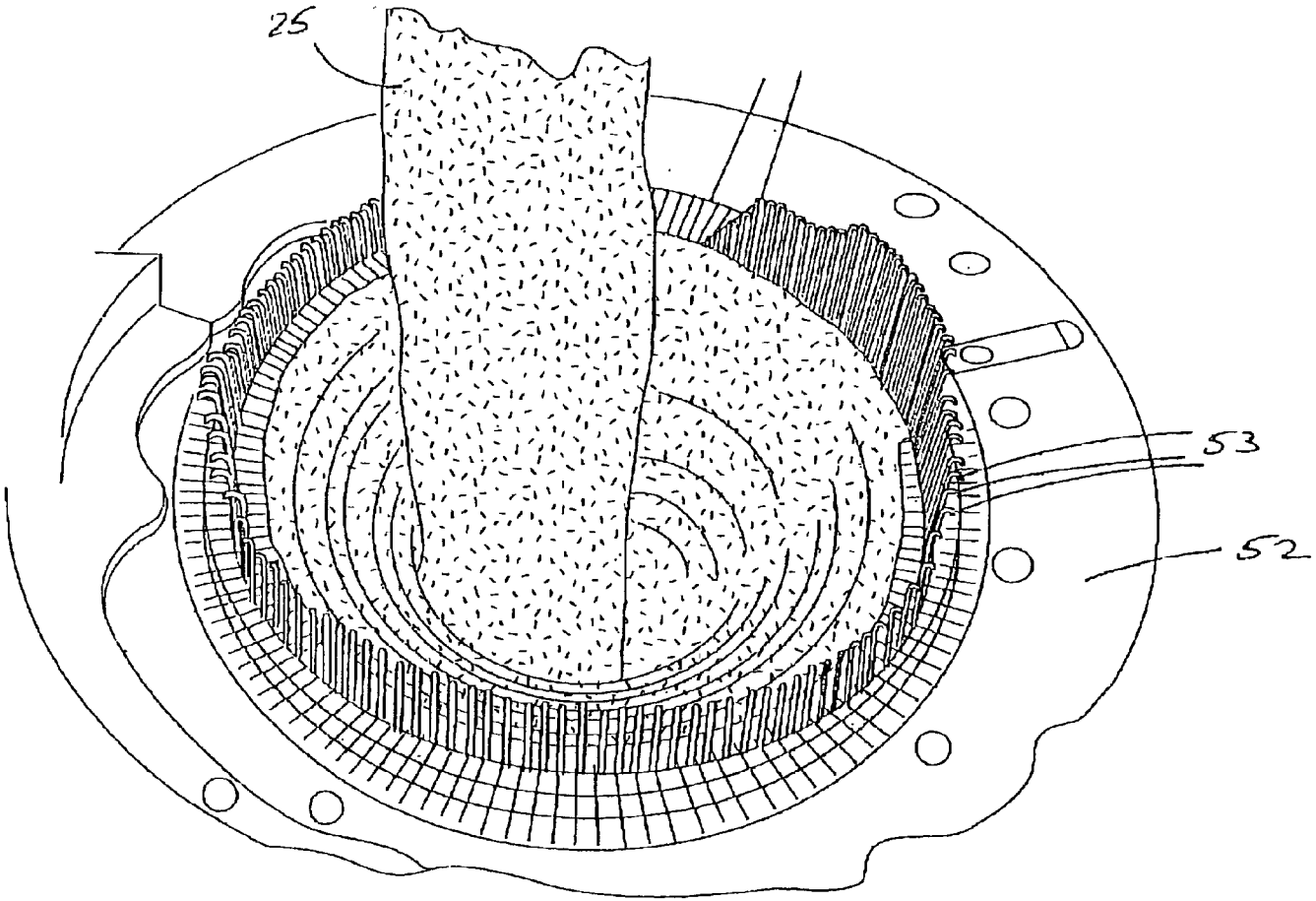
FIG. 17 is a perspective view illustrating the knitting of an outer leg portion of the sock.
Figure 18:
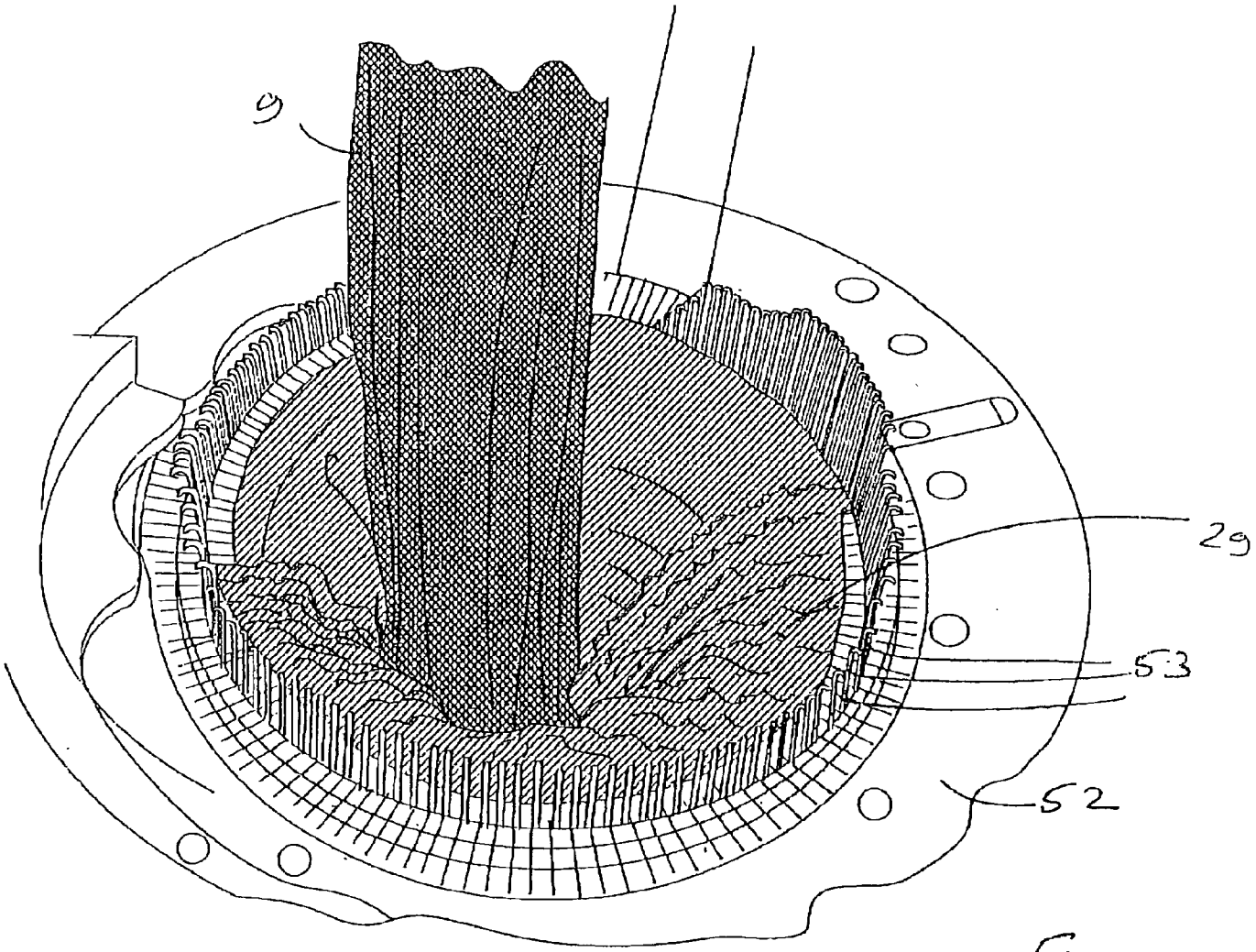
FIG. 18 is a perspective view illustrating the knitting of an outer foot portion of the sock.
Figure 19:
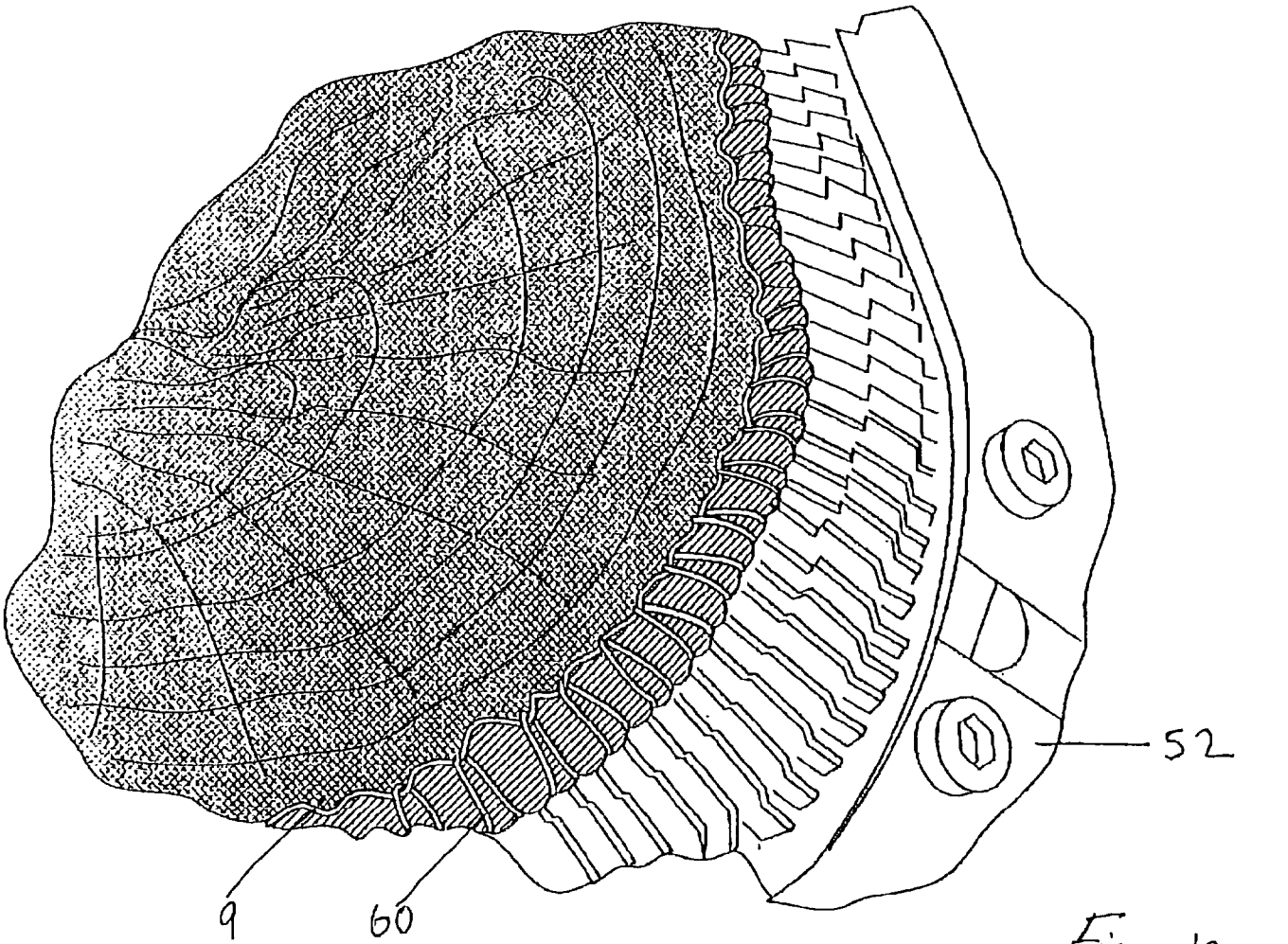
FIG. 19 is a perspective view illustrating the joining of the internal toe to the external toe.

At this stage, the internal toe is formed from Teflon yarn by the cylinder which is reciprocated, thereby knitting the required size pouch 11, that is continuous with the inner foot 12 which is knitted with the cylinder rotating in a forward direction that is continuous with the inner heel 13 which is knitted with the cylinder being reciprocated, thereby knitting the required size heel pouch. This in turn is continuous with the inner ankle 14 (FIGS. 15 and 16).

The technical yarn is withdrawn and another yarn appropriate for the performance properties required (for example Tactel Nylon) is introduced at the main feed by means of selecting a different yarn carrier. All other yarn carriers are withdrawn.

The upper inner leg 15 is then knitted, which is continuous with the inner elasticated welt 5, constructed with the same yarns used on the outer elasticated leg 25 (FIG. 12) which is continuous with the outer elasticated welt 8 which is continuous with the outer elasticated layer leg which is continuous with the cushion outer layer terry high heel 24 which is continuous with a cushion reciprocated outer layer heel 23 pouch which in turn is continuous with the cushion outer layer foot 22 which is continuous with the outer layer cushion ring toe 7 which is continuous with the padded outer layer reciprocated toe pouch 21. The method and sequence of making will support the inclusion of motifing design and/or differing stitch structures on the outer layer fabric if required.

The next step is to release the inner layer preparation courses of the inner toe 4 from the dial elements 51 and to place them on the cylinder elements 53 containing the outer toe 7. The inner layer toe 4 is now automatically aligned with the outer layer toe 7, wale stitch to wale stitch. The outer and inner toes 4, 7 are then joined by a Nylon knitting yarn 70.

Figures 21, 22, 23, 24, 25:
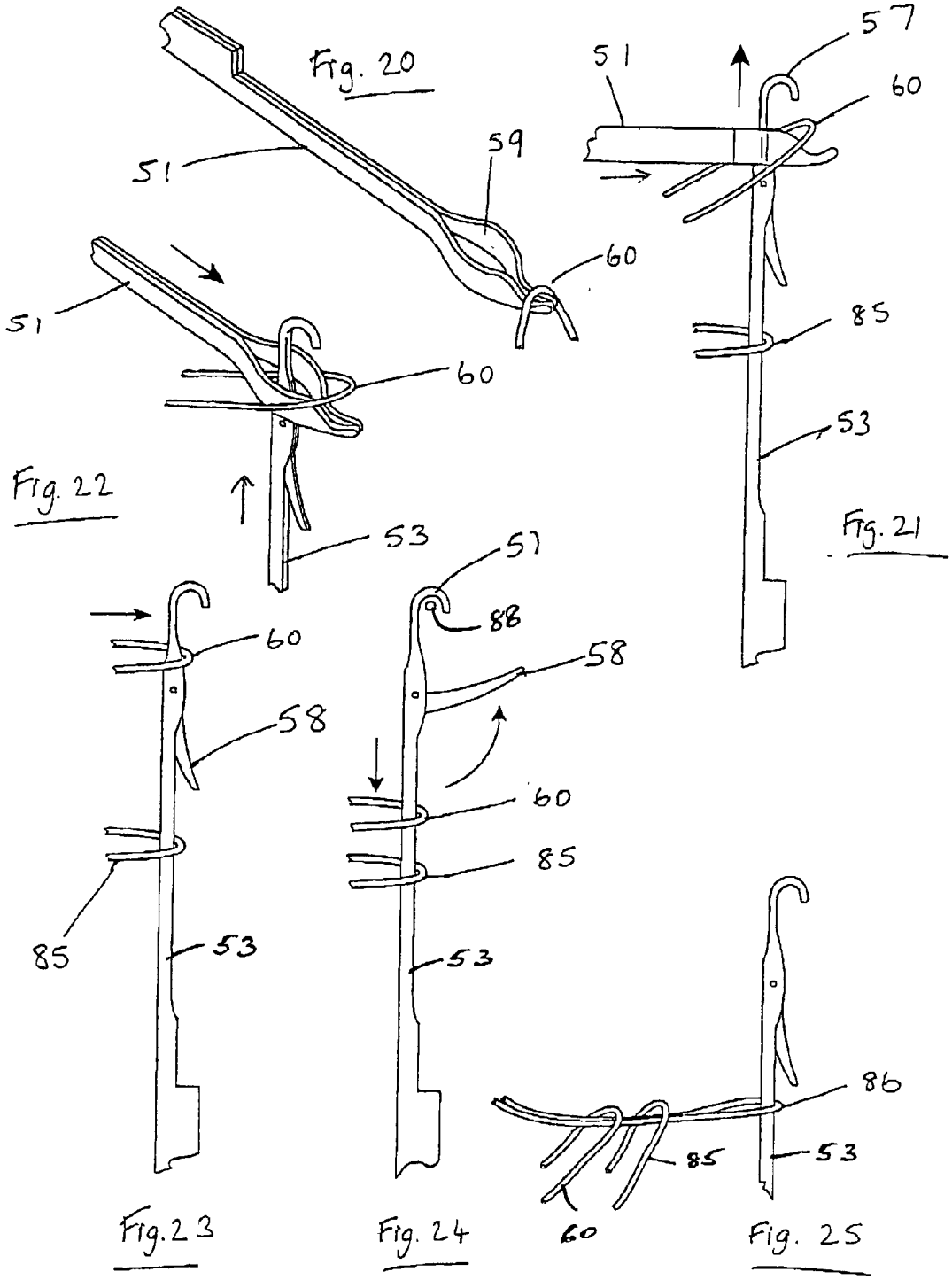
FIG. 21 is a side view of a dial loop being transferred to a cylinder needle.
FIG. 22 is a perspective view of a dial loop being transferred to a cylinder needle.
FIG. 23 is a side view of a dial loop stitch transferred onto a cylinder needle.
FIG. 24 is a view of the dial loop stitch transferred onto a cylinder needle in proximity to a stitch loop of the outer toe formed on the cylinder needle prior to the transfer.
FIG. 25 is a view of the stitch loop of the outer toe and the transferred dial loop stitch of FIG. 24 after a further loop has been formed on the cylinder needle.
Figure 22:
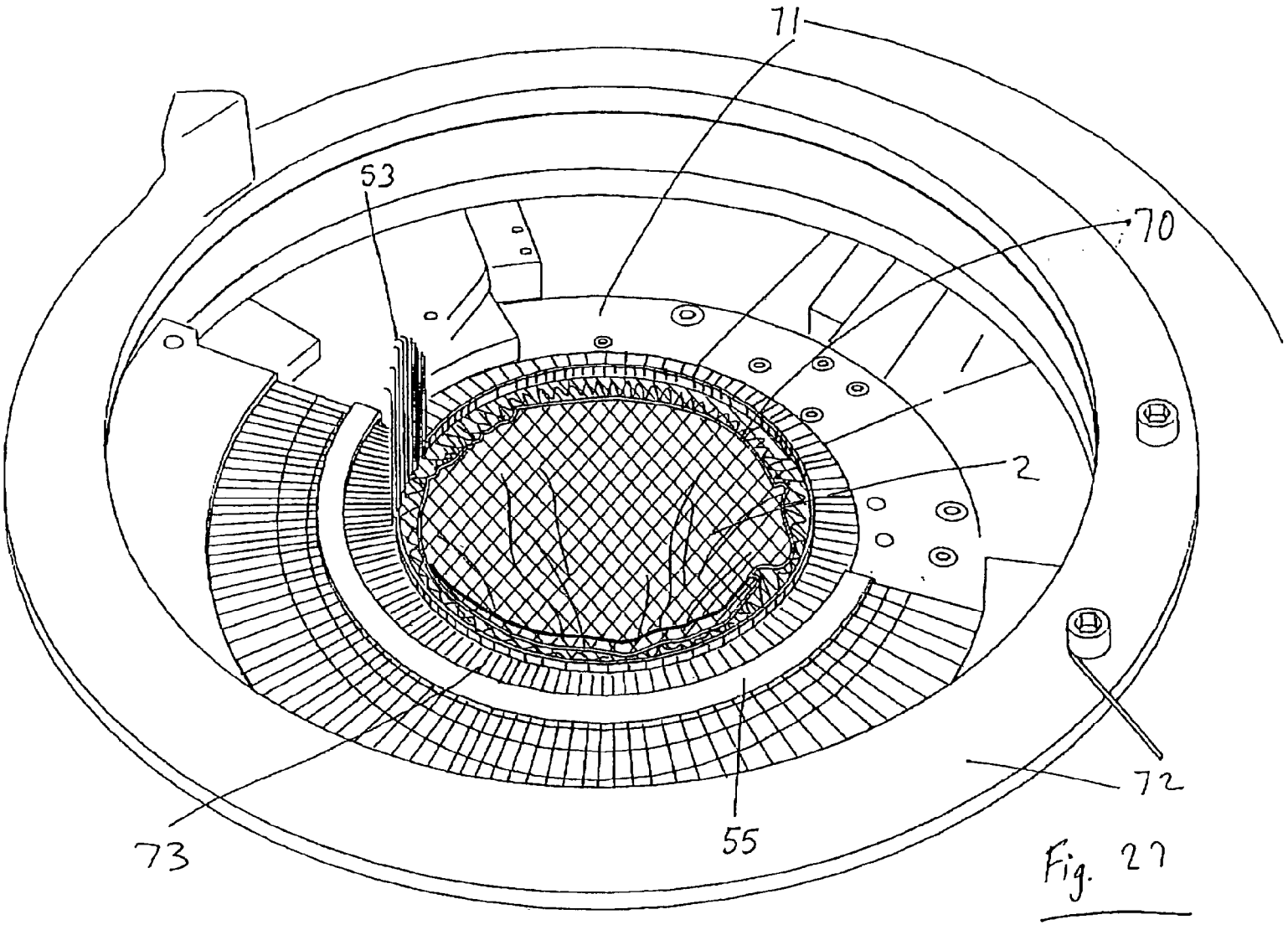

Referring to FIG. 20 a dial element 51 comprising an opening 59 is illustrated holding a loop 60 of the preparation course of the inner toe portion 4. Referring to FIG. 21 a cylinder needle 53 comprising a needle hook 57 and a needle latch 58 is illustrated holding a loop 85 of the last course of the outer toe 7. The loops 60 are transferred from the dial element 51 as illustrated with reference to FIGS. 21 and 22 by the dial element 51 moving forwards to open out the loop 60 and the cylinder needle 53 moving upwards to pass through the opening 59 in the dial element and through the open loop 60. Referring to FIG. 23 the loop 60 is shown at the point of transfer onto the needle 53 which also holds the loop 85. The step of aligning the loops 60 of the inner toe with the loops 85 of outer toe is further illustrated in FIG. 26(*a*). Referring to FIG. 26(*b*) the step knitting of a course 86 to join the inner and outer layers is shown. As shown in FIGS. 26 (*c*) and (*d*) additional courses 86 may be knit after the first one connecting the inner and outer layers.

Referring to FIG. 24 new yarn 88 is delivered to the needle hook 57, the latch 58 of the needle is moved upwards so that, when the needle moves down, the yarn can be carried through the loops 60 and 85 to knit a loop 86 of a new course which connects the toe ends of the inner and outer layers 4 and 7. A completed loop 86 is illustrated in FIG. 25.

The head of the knitting machine that holds the dial, yarn and yarn fingers is lifted and separated from the cylinder on which the inner and outer toes 4, 7 are mounted.

Figure 28:
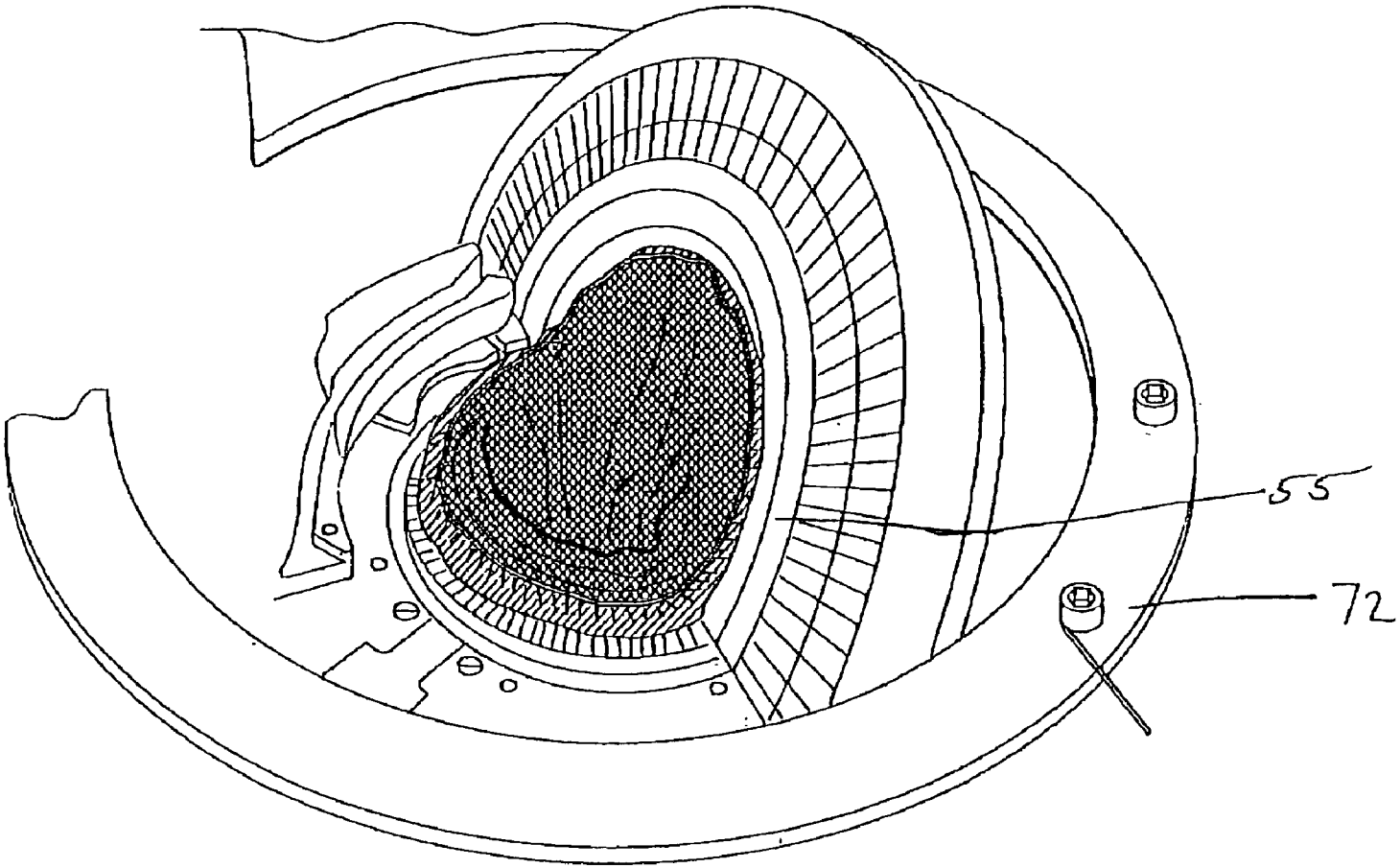
Figure 29:
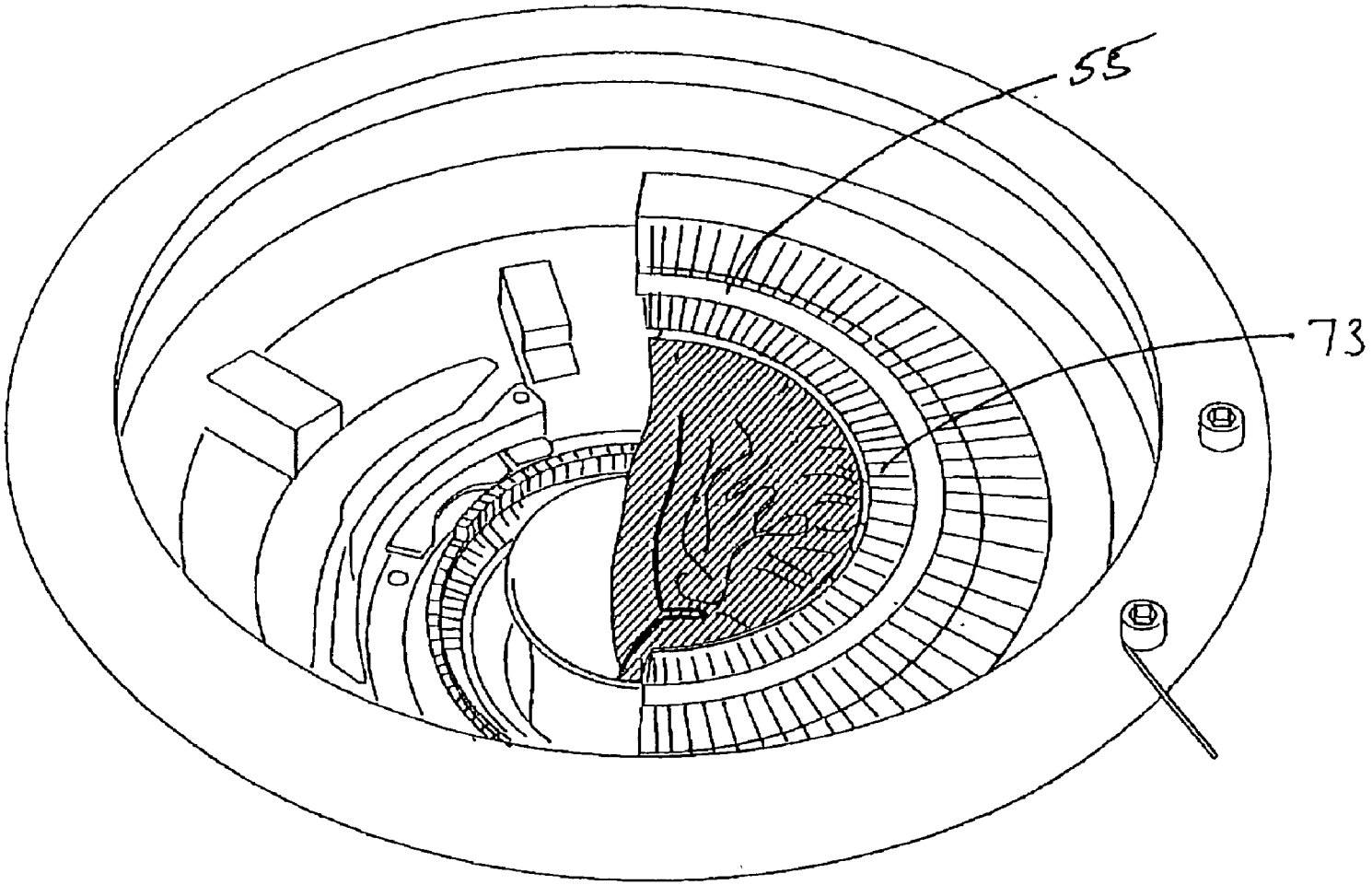

Referring to FIG. 27 a transfer arm 72 comprises a sinker cap 71 and a halfmoon transfer unit 55 comprising transfer elements 73. The stitches 86 of the final course of the inner and outer toes are transferred from the needles 53 of the cylinder to the dial elements of the transfer arm in two steps. In a first step the transfer arm 55 is moved over and dropped onto the cylinder to align Lintoe elements 73 with a first semi-circle of cylinder elements 53 holding the joined inner and outer toes 4, 7. The stitches 86 of the first semi-circle portion are transferred from the cylinder needles 53 to the Lintoe elements 73 of the halfmoon transfer unit 55. In a second step, when all the loops 86 of the first portion have been transferred to the adjacent elements 73 the transfer arm 55 is flipped over as illustrated in FIGS. 28 and 29 so that the transfer elements are adjacent to the cylinder needles 53 of the second semi-circle of the cylinder elements which are holding the loops 86 of the remaining portion of the toe. The remaining stitches 86 are transferred to the adjacent transfer elements 73. Each transfer element now holds two loops 86.

Figure 30:
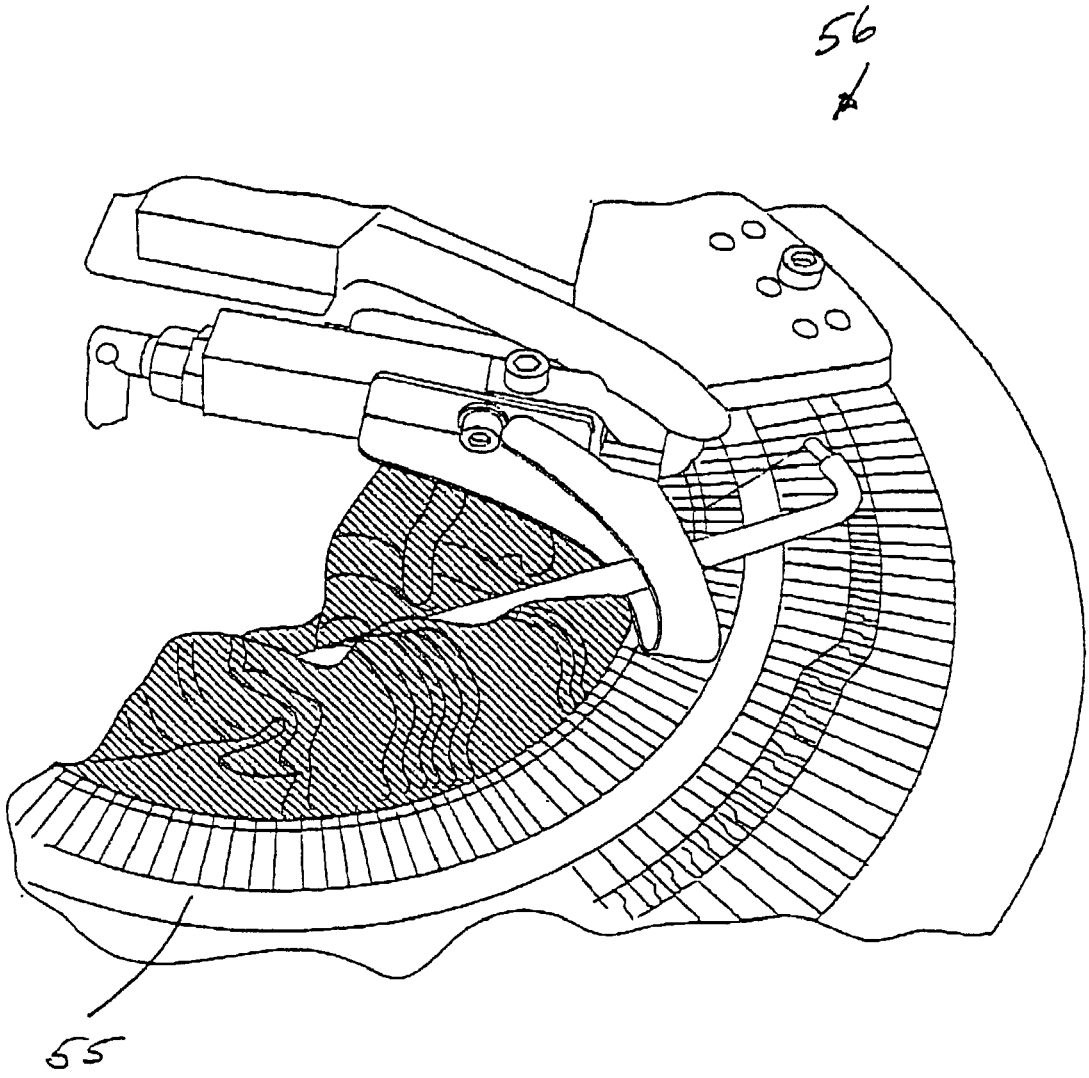
FIG. 30 is a perspective view illustrating the closing of the toe seam with a Lintoe attachment.

Referring to FIG. 30 the joined toes 4, 7 are now on the Lintoe elements and the transfer unit 55 is moved over to a sewing head 56 of the Lintoe machine. The sewing head 56 forms a flat seam at the toes 4, 7. The finished double layer sock is discharged from the knitting machine complete.

Figure 31:
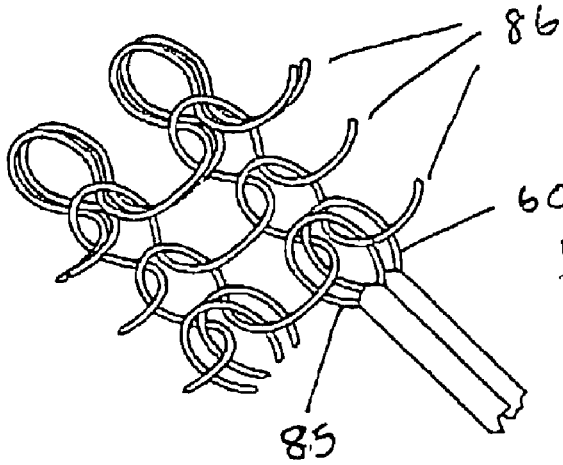
FIG. 31 is a view illustrating the loops of the joined toe after they have been transferred onto a Lintoe element.
Figure 32:
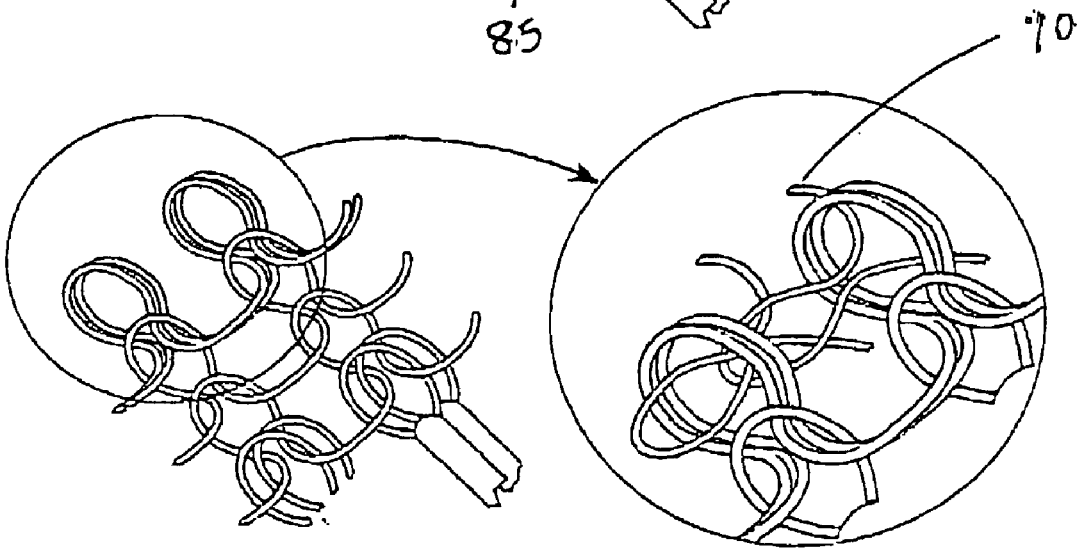
FIG. 32 is a view illustrating stitches of the toe closure seam being knit through the loops of the inner and outer toe layers of FIG. 31.

The step of closing the seam is illustrated in more detail in FIG. 31, which shows two stitch loops 86 of opposing portions of the last knit course located in proximity to each other on the same transfer element after the transfer has been completed. The step of knitting the toe closing seam 10 is illustrated in FIG. 32.

In the invention the inner toe end and the outer toe end are first joined stitch for stitch to form a single composite toe end and the single composite toe end is closed to provide a substantially flat toe seam. The composite toe end comprises a number of courses in this case at least 2 courses of yarn. This results in an exceptionally flat toe seam which at least in the inner foot contacting layer is recessed with respect to the main body of the sock. The toe seam generally has a thickness that is less than the thickness of the main body of the sock adjacent the seam.

EXAMPLE 1

A double layer sock is produced on a Sangiacomo circular knitting machine with a Lintoe attachment as follows.

The dial is prepared by attaching an Elastane yarn (which may be coated with a fluoropolymer). The connecting yarn is led from the cylinder needles to dial elements.

A fluoropolymer fiber is then introduced by a yarn carrier change.

The cylinder is reciprocated to produce an internal toe pouch using the fluoropolymer fiber.

The internal foot of the sock is then knit by the cylinder.

The internal heel is then knit from the fluoropolymer fiber by reciprocating the cylinder.

The inner ankle (high heel) is then knitted continuously using the fluoropolymer fiber.

The yarn carrier is then changed so that the cylinder is fed with Tactel Nylon fiber which is used to knit the leg part of the inner sock.

When the leg part has been knit there is another yarn carrier change to introduce a mixture of cotton, Nylon and elastic yarn to knit the internal welt structure. This is the elasticated region around the top of the leg part of the sock. It is knitted on the internal sock for appearance only. It could be provided on the external sock.

The knitting is continued to form the leg part of an outer sock which is continuous with the inner sock. During all of the knitting of the inner and outer sock sections the initial connecting yarn is still held on the dial elements.

The elastic yarn is withdrawn and the external ankle region of the outer sock layer is knit using cotton Lycra yarn.

The yarn is changed again. Cotton and Nylon yarns are used to knit the outer heel of the sock which, on completion of the sock, will be aligned with the heel section of the inner sock layer. Cotton and Nylon are used in this region to provide a comfort fit with high tensile strength at the heel which is the hardest wearing part of the sock.

Using cotton and Lycra yarns, knitting is continued to form the external foot.

An external toe is then knit by reciprocating the cylinder elements. The external toe is of cotton and Nylon yarn.

The toe of the inner sock layer remains connected to the dial elements.

The internal toe is then aligned with the cylinder needles which already hold the inner toe.

The dial elements are then moved to deposit the internal toe held on the dial onto the cylinder needles which hold the external toe.

While positioned on the cylinder needles the fabrics of the inner and outer toes are knitted together using Nylon knitting yarn.

The head of the machine that holds the dial, yarn and yarn fingers is lifted and separated from the cylinder on which the inner and outer toes are mounted. In this configuration all of the cylinder elements are retracted.

An arm of the Lintoe attachment then moves over, drops and locates on pegs to align Lintoe elements with the cylinder elements holding the inner and outer toes.

The transfer half moon shaped element carried by the Lintoe arm is flipped over through 180° to transfer the yarn.

The cylinder then moves up to join the two halves of the sock at the toe.

All the fabric is taken off from the long cylinder needles and transferred to Lintoe elements on the transfer half moon.

The Lintoe transfer arm lifts up and sweeps over to a sewing head of the Lintoe attachment.

The transfer arm drops down to deliver the toe inner and outer onto the Lintoe sewing head which forms a flat seam at the toes using a Nylon yarn.

The double layer sock with a flat seam at the inner and outer toes is then discharged from the knitting machine.

It will be noted that the sock is knit by starting at the inner toe which is mounted on the dial elements until the inner and outer layers of the sock have been knit. The knitting ends with the outer toe on the cylinder elements of the knitting machine. The inner toe is then transferred from the dial elements so that the inner and outer toes are lined up stitch for stitch. A conventional Lintoe machine is then used to join the sock layers with a flat seam.

The sock of the invention is manufactured complete in a single process and incorporates a flat seam joining the two layers of fabric. This guarantees wale stitch to wale stitch alignment of both sock layers making up the final double sock which in turn gives perfect alignment of the double structure. Single process manufacture in a programmed, uninterrupted production cycle without manual intervention and requiring no hand finishing results in a level of precision and consistency in the dimensions and finish of the double layer sock of the invention unachievable in the manufacture of conventional double layer socks, making it ideally suited for preventive care applications.

The single process manufacture of the double sock of the invention allows the knitting the inner sock in single, unplated, low friction fiber especially PTFE which has the lowest coefficient of friction of all known fibers. This gives the sock what is believed to be the lowest achievable coefficient of friction of any sock at both the sock to foot interface and at the inner to outer sock interface (socks of same construction, i.e. terry cushion to the inner surface of the outer sock). This is achieved using a quantity of about 9 gms of Teflon fiber.

PTFE fiber is heat resistant which keeps the foot to sock interface cooler than other conventional yarns. This cooler surface contact with the skin, the lower friction at both inner interfaces resulting from the 100% PTFE layer and reduced pressure through the terry cushion padding combine to keep the foot surface more comfortable and drier (sweat glands are less stimulated) and therefore less prone to infection and much less so to irritations, sores and blisters.

PTFE is hydrophobic so that any moisture will pass through the thin inner Teflon layer into the outer layer which will have a hydrophilic yarn as the main fibre in its composition. Apart from the reduction in pressure to the foot, the terry cushion will improve the thermal insulation of the sock over single layer products. The extremely light and thin but very strong inner sock layer means that the overall bulk and weight of the complete double sock is only marginally heavier than many single layer sock products with terry fabric in the foot and therefore is comfortable to wear in either normal or orthotically modified shoes.

PTFE is also chemically inert, making it a very stable medium to have at the contact point with skin.

Thus, the invention provides a sock which combines a very thin, low friction inner layer with terry cushion padding to the foot in the outer layer, finished with a flat seam. The invention significantly reduces both friction and pressure at the interface to the foot, wicks moisture away and helps keep the skin surface cool. It can therefore help reduce and prevent callus and blister formation and other types of skin breakdown and is ideally suited for use by people with diabetes and other medical conditions which place them at risk of serious foot complications.

In the double layer structure of the invention, PTFE fiber is incorporated into a single knit fabric on the inner sock while terry cushion in a conventional yarn is incorporated into the foot area in the outer layer.

It will be appreciated that the sock yarn may be varied according to the intended use. For example, there may be one sock suitable for mild/warm weather conditions and another sock more suited for colder weather wear.

The warm weather outer sock will most likely be comprised of about 85% cotton and plated with a 13% Nylon, 2% Lycra composite yarn. The inner sock is 100% Teflon with trace percentages of both Nylon and Nylon/Lycra composite yarns in the toe seam.

The winter version will have a yarn with better thermal insulation properties replacing cotton or equivalent as the main yarn. This yarn will most likely be Coolmax, wool or a wool variant such as Smartwool which does not shrink. Otherwise, the composition will approximate the warm weather sock. The specification of the composite Nylon/Lycra plating yarn may vary to suit the properties and knitting characteristics of the main outer sock yarn. It is likely that the main outer yarns in both variants will be treated with anti bacterial and anti fungal agents. It is also possible that composite main yarns will be used in which a treated fiber would be core spun with the main fiber.

The sock may incorporate a silver coated Nylon fiber as sold under the Trade Mark X-static by Noble Medical Technologies of the US. The fiber has a layer of silver permanently bonded to a Nylon fiber substrate without adversely affecting the performance characteristics of the Nylon. The silver coated fiber is effective as an anti-microbial agent and is useful in eliminating body odour and minimising static. The fiber also helps to regulate the temperature of the body surface in close proximity or contact with it. The yarn retains the performance and tactile characteristics of Nylon and can therefore by used in knits, wovens and non wovens either as a filament or spun yarn. The yarn offers the medical benefits known to be inherent to pure silver but in textile format.

EXAMPLE 2

A double layer sock is produced on a Sangiacomo circular knitting machine with a Lintoe attachment as follows.

The dial is prepared by attaching an Elastane yarn (which may be coated with Teflon). The connecting yarn is led from the cylinder needles to dial elements.

Silver coated Nylon fiber is then introduced by a yarn carrier change.

The cylinder is reciprocated to produce an internal toe pouch using the silver coated Nylon fiber.

The internal foot of the sock is then knit by the cylinder.

The internal heel is then knit from the silver coated Nylon fiber by reciprocating the cylinder.

The inner ankle (high heel) is then knitted continuously using the silver coated Nylon fiber.

The yarn carrier is then changed so that the cylinder is fed with Tactel Nylon fiber which is used to knit the leg part of the inner sock.

When the leg part has been knit there is another yarn carrier change to introduce a mixture of cotton, Nylon and elastic yarn to knit the internal welt structure. This is the elasticated region around the top of the leg part of the sock. It is knitted on the internal sock for appearance only. It could be provided on the external sock.

The knitting is continued to form the leg part of an outer sock which is continuous with the inner sock. During all of the knitting of the inner and outer sock sections the initial connecting yarn is still held on the dial elements.

The elastic yarn is withdrawn and the external ankle region of the outer sock layer is knit using cotton Lycra yarn.

The yarn is changed again. Cotton and Nylon yarns are used to knit the outer heel of the sock which, on completion of the sock, will be aligned with the heel section of the inner sock layer. Cotton and Nylon are used in this region to provide a comfort fit with high tensile strength at the heel which is the hardest wearing part of the sock. Using cotton and Lycra yarns, knitting is continued to form the external foot.

An external toe is then knit by reciprocating the cylinder elements. The external toe is of cotton and Nylon yarn.

The toe of the inner sock layer remains connected to the dial elements.

The internal toe is then aligned with the cylinder needles which already hold the inner toe.

The dial elements are then moved to deposit the internal toe held on the dial onto the cylinder needles which hold the external toe.

While positioned on the cylinder needles the fabrics of the inner and outer toes are knitted together using Nylon knitting yarn.

The head of the machine that holds the dial, yarn and yarn fingers is lifted and separated from the cylinder on which the inner and outer toes are mounted. In this configuration all of the cylinder elements are retracted.

An arm of the Lintoe attachment then moves over, drops and locates on pegs to align Lintoe elements with the cylinder elements holding the inner and outer toes.

The transfer half moon shaped element carried by the Lintoe arm is flipped over through 180° to transfer the yarn.

The cylinder then moves up to join the two halves of the sock at the toe.

All the fabric is taken off from the long cylinder needles and transferred to Lintoe elements on the transfer half moon.

The Lintoe transfer arm lifts up and sweeps over to a sewing head of the Lintoe attachment.

The transfer arm drops down to deliver the toe inner and outer onto the Lintoe sewing head which forms a flat seam at the toes using a Nylon yarn.

The double layer sock with a flat seam at the inner and outer toes is then discharged from the knitting machine.

It will be noted that the sock is knit by starting at the inner toe which is mounted on the dial elements until the inner and outer layers of the sock have been knit. The knitting ends with the outer toe on the cylinder elements of the knitting machine. The inner toe is then transferred from the dial elements so that the inner and outer toes are lined up stitch for stitch. A conventional Lintoe machine is then used to join the sock layers with a flat seam.

The sock of the invention is manufactured complete in a single process and incorporates a flat seam joining the two layers of fabric. This guarantees wale stitch to wale stitch alignment of both sock layers making up the final double sock which in turn gives perfect alignment of the double structure. Single process manufacture in a programmed, uninterrupted production cycle without manual intervention and requiring no hand finishing results in a level of precision and consistency in the dimensions and finish of the double layer sock of the invention unachievable in the manufacture of conventional double layer socks, making it ideally suited for preventive care applications.

The single process manufacture of the double sock of the invention allows the knitting of at least portion, especially the foot portion of the inner sock in single, unplated, X-static fiber It will be appreciated that the sock yarn may be varied according to the intended use. For example, there may be one sock suitable for mild/warm weather conditions and another sock more suited for colder weather wear.

The warm weather outer sock will most likely be comprised of about 85% cotton and plated with a 13% Nylon, 2% Lycra composite yarn.

The winter version will have a yarn with better thermal insulation properties replacing cotton or equivalent as the main yarn. This yarn will most likely be Coolmax, wool or a wool variant such as Smartwool which does not shrink. Otherwise, the composition will approximate the warm weather sock. The specification of the composite Nylon/Lycra plating yarn may vary to suit the properties and knitting characteristics of the main outer sock yarn.

The sock thus incorporates a silver coated Nylon fiber having a layer of silver permanently bonded to a Nylon fiber substrate without adversely affecting the performance characteristics of the Nylon. The silver coated Nylon fiber is effective as an anti-microbial agent and is useful in eliminating body odour and minimising static. The fiber also helps to regulate the temperature of the body surface in close proximity or contact with it.

The extremely light and thin but very strong inner sock layer means that the overall bulk and weight of the complete double sock is only marginally heavier than many single layer sock products with terry fabric in the foot and therefore is comfortable to wear in either normal or orthotically modified shoes.

Knitting of a foot portion of an inner sock in a 1×1 stitch, unplated construction from silver coated Nylon yarn creates a smoothly constructed antimicrobial and antifungal interface to both the foot and the inner surface of the outer sock. The invention provides an inner sock with at least the foot portion composed of unplated silver coated Nylon yarn with the outer and inner sock layers joined at the welt end and toe seam. The toe seam is stitch linked automatically, giving a flat linked seam. The outer sock can be yarn composed and structured so as to provide varied benefits to the user.

In a double layer structure, the silver coated Nylon yarn can be incorporated into a single knit unplated fabric on the inner sock while terry cushion in a conventional yarn can be incorporated into the foot area in the outer layer.

Because the silver coated Nylon fiber is next to the skin in this construction the efficiency of the fiber is optimised in preventing foot odour and athletes foot.

EXAMPLE 3

A double layer sock is produced on a Sangiacomo circular knitting machine with a Lintoe attachment as follows.

The dial is prepared by attaching an Elastane yarn (which may be coated with Teflon). The connecting yarn is led from the cylinder needles to dial elements.

Teflon fibre or yarn, silver coated fibre or yarn and Lycra fibre or yarn are then introduced by yarn carrier changes. The cylinder is reciprocated to produce an internal toe pouch using these 3 fibres.

The internal foot of the sock is then knit by the cylinder using these 3 fibres.

The internal heel is then knit from the Teflon fibre or yarn, the silver coated fibre or yarn and the Lycra fibre or yarn by reciprocating the cylinder.

The inner ankle (high heel) is then knitted continuously using the same three fibres.

The yarn carrier is then changed so that the cylinder is fed with Tactel Nylon fibre which is used to knit the leg part of the inner sock.

When the leg part has been knit there is another yarn carrier change to introduce a mixture of wool, Nylon and elastic yarn to knit the internal welt structure. This is the elasticated region around the top of the leg part of the sock. It is knitted on the internal sock for appearance only. It could be provided on the external sock.

The knitting is continued to form the leg part of an outer sock which is continuous with the inner sock. During all of the knitting of the inner and outer sock sections the initial connecting yarn is still held on the dial elements.

The elastic yarn is withdrawn and the external ankle region of the outer sock layer is knit using wool and Lycra yarns.

The yarn is changed again. Wool and Nylon yarns are used to knit the outer heel of the sock which, on completion of the sock, will be aligned with the heel section of the inner sock layer. Wool and Nylon are used in this region to provide a comfort fit with high tensile strength at the heel which is the hardest wearing part of the sock.

Using wool and Lycra yarns, knitting is continued to form the external foot.

An external toe is then knit by reciprocating the cylinder elements. The external toe is of wool and Nylon yarn.

The toe of the inner sock layer remains connected to the dial elements.

The internal toe is then aligned with the cylinder needles which already hold the inner toe.

The dial elements are then moved to deposit the internal toe held on the dial onto the cylinder needles which hold the external toe.

While positioned on the cylinder needles the fabrics of the inner and outer toes are knitted together using Nylon knitting yarn.

The head of the machine that holds the dial, yarn and yarn fingers is lifted and separated from the cylinder on which the inner and outer toes are mounted. In this configuration all of the cylinder elements are retracted.

An arm of the Lintoe attachment then moves over, drops and locates on pegs to align Lintoe elements with the cylinder elements holding the inner and outer toes.

The transfer half moon shaped element carried by the Lintoe arm is flipped over through 180° to transfer the yarn.

The cylinder then moves up to join the two halves of the sock at the toe.

All the fabric is taken off from the long cylinder needles and transferred to Lintoe elements on the transfer half moon.

The Lintoe transfer arm lifts up and sweeps over to a sewing head of the Lintoe attachment.

The transfer arm drops down to deliver the toe inner and outer onto the Lintoe sewing head which forms a flat seam at the toes using a Nylon yarn.

The double layer sock with a flat seam at the inner and outer toes is then discharged from the knitting machine.

It will be noted that the sock is knit by starting at the inner toe which is mounted on the dial elements until the inner and outer layers of the sock have been knit. The knitting ends with the outer toe on the cylinder elements of the knitting machine. The inner toe is then transferred from the dial elements so that the inner and outer toes are lined up stitch for stitch. A conventional Lintoe machine is then used to join the sock layers with a flat seam.

The sock of the invention is manufactured complete in a single process and incorporates a flat seam joining the two layers of fabric. This guarantees wale stitch to wale stitch alignment of both sock layers making up the final double sock which in turn gives perfect alignment of the double structure. Single process manufacture in a programmed, uninterrupted production cycle without manual intervention and requiring no hand finishing results in a level of precision and consistency in the dimensions and finish of the double layer sock of the invention unachievable in the manufacture of conventional double layer socks, making it ideally suited for preventive care applications.

The single process manufacture of the double sock of the invention allows the knitting the inner sock in a plated structure, deploying a low friction fluoropolymer yarn such as the PTFE fibre Teflon (from DuPont) to the inner fabric face interfacing with the surface of the foot and an anti-microbial and anti-fungal yarn or fibre preferably a silver coated fibre or yarn to the outer face interfacing with the inner face of the outer sock layer with an elastomeric yarn preferably Lycra sandwiched in the middle of the inner sock fabric . The use of a low friction fibre, especially PTFE which has the lowest coefficient of friction of all known fibres gives the sock what is believed to be the lowest achievable coefficient of friction of any cushion terry sock at the sock to foot interface.

PTFE fibre is heat resistant which keeps the foot to sock interface cooler than other conventional yarns. This cooler surface contact with the skin, the lower friction at the inner sock foot interface resulting from the 100% PTFE layer and reduced pressure through the terry cushion padding to the outer sock layer combine to keep the foot surface more comfortable and drier (sweat glands are less stimulated) and therefore less prone to infection and much less so to irritations, sores and blisters.

The silver coated fibre reduces the risk of secondary infection and eliminates and/or prevents foot odour and athletes foot.

Both the PTFE and silver coated yarns are hydrophobic so that any moisture will pass through the thin inner Teflon/silver coated yarn sock layer into the outer layer which will have a hydrophilic yarn as the main fibre in its composition. Apart from the reduction in pressure to the foot, the terry cushion will improve the thermal insulation of the sock over single layer products. The thin but very strong inner sock layer means that the overall bulk and weight of the complete double sock is only marginally heavier than many single layer sock products with terry fabric in the foot and therefore is comfortable to wear in properly fitted boots and other active footwear.

PTFE is also chemically inert, making it a very stable medium to have at the contact point with skin.

Thus, the invention provides a sock which combines a very thin, low friction inner layer with terry cushion padding to the foot in the outer layer, finished with a flat seam. The invention significantly reduces both friction and pressure at the interface to the foot, wicks moisture away and helps keep the skin surface cool. It can therefore help reduce and prevent callus and blister formation and other types of skin breakdown and is ideally suited for use by people with diabetes and other medical conditions which place them at risk of serious foot complications.

It will be appreciated that the sock yarn may be varied according to the intended use. For example, there may be one sock suitable for mild/warm weather conditions and another sock more suited for colder weather wear.

The warm weather outer sock will most likely be comprised of about 85% coolmax and plated with a 13% Nylon, 2% Lycra composite yarn. The inner sock is comprised of Teflon, a silver coated fibre and an elastomeric yarn with trace percentages of both Nylon and Nylon/Lycra composite yarns in the toe seam.

The winter version will have a yarn with better thermal insulation properties replacing coolmax or equivalent as the main yarn. This yarn will most likely be wool or a wool variant such as Smartwool which does not shrink. Otherwise, the composition will approximate the warm weather sock. The specification of the composite Nylon/Lycra plating yarn may vary to suit the properties and knitting characteristics of the main outer sock yarn.

The sock may incorporate a silver coated Nylon fibre as sold under the Trade Mark X-static by Noble Medical Technologies of the US. The fibre has a layer of silver permanently bonded to a Nylon fibre substrate without adversely affecting the performance characteristics of the Nylon. The silver coated fibre is effective as an antimicrobial agent and is useful in eliminating body odour and minimising static. The fibre also helps to regulate the temperature of the body surface in close proximity or contact with it and will reduce the risk of secondary infection of wounds, blisters and sores on the foot.

The incorporation of a yarn or fibre with a silver content in socks designed for military and vigorous activewear will in addition to eliminating or preventing foot odour and athletes foot, reduce the risk of secondary bacterial and fungal infection in blister wounds and other foot sores, thereby permitting continued physical activity if necessary.

EXAMPLE 4

A double layer sock is produced on a Sangiacomo circular knitting machine with a Lintoe attachment as follows.

The dial is prepared by attaching an Elastane yarn (which may be coated with PTFE). The connecting yarn is led from the cylinder needles to dial elements.

A composite yarn comprised of a blend of PTFE fibre and another conventional fibre (hereafter referred to as the PTFE blend) (an example is Dupont's Teflon SY yarn, comprised of 50% PTFE and 50% dacron fibre) is then introduced by a yarn carrier change. Dacron is an engineered polyester.

The cylinder is reciprocated to produce an internal toe pouch using the PTFE blended yarn.

The internal foot of the sock is then knit by the cylinder.

The internal heel is then knit from the PTFE blended yarn by reciprocating the cylinder.

The inner ankle (high heel) is then knitted continuously using the PTFE blended yarn.

The yarn carrier is then changed so that the cylinder is fed with Tactel Nylon fiber which is used to knit the leg part of the inner sock.

When the leg part has been knit there is another yarn carrier change to introduce a mixture of cotton, Nylon and elastic yarn to knit the internal welt structure. This is the elasticated region around the top of the leg part of the sock. It is knitted on the internal sock for appearance only. It could be provided on the external sock.

The knitting is continued to form the leg part of an outer sock which is continuous with the inner sock. During all of the knitting of the inner and outer sock sections the initial connecting yarn is still held on the dial elements.

The elastic yarn is withdrawn and the external ankle region of the outer sock layer is knit using cotton Lycra yarn.

The yarn is changed again. Cotton and Nylon yarns are used to knit the outer heel of the sock which, on completion of the sock, will be aligned with the heel section of the inner sock layer. Cotton and Nylon are used in this region to provide a comfort fit with high tensile strength at the heel which is the hardest wearing part of the sock.

Using cotton and Lycra yarns, knitting is continued to form the external foot.

An external toe is then knit by reciprocating the cylinder elements. The external toe is of cotton and Nylon yarn.

The toe of the inner sock layer remains connected to the dial elements.

The internal toe is then aligned with the cylinder needles which already hold the inner toe.

The dial elements are then moved to deposit the internal toe held on the dial onto the cylinder needles which hold the external toe.

While positioned on the cylinder needles the fabrics of the inner and outer toes are knitted together using Nylon knitting yarn.

The head of the machine that holds the dial, yarn and yarn fingers is lifted and separated from the cylinder on which the inner and outer toes are mounted. In this configuration all of the cylinder elements are retracted.

An arm of the Lintoe attachment then moves over, drops and locates on pegs to align Lintoe elements with the cylinder elements holding the inner and outer toes.

The transfer half moon shaped element carried by the Lintoe arm is flipped over through 180° to transfer the yarn.

The cylinder then moves up to join the two halves of the sock at the toe.

All the fabric is taken off from the long cylinder needles and transferred to Lintoe elements on the transfer half moon.

The Lintoe transfer arm lifts up and sweeps over to a sewing head of the Lintoe attachment.

The transfer arm drops down to deliver the toe inner and outer onto the Lintoe sewing head which forms a flat seam at the toes using a Nylon yarn.

The double layer sock with a flat seam at the inner and outer toes is then discharged from the knitting machine.

It will be noted that the sock is knit by starting at the inner toe which is mounted on the dial elements until the inner and outer layers of the sock have been knit. The knitting ends with the outer toe on the cylinder elements of the knitting machine. The inner toe is then transferred from the dial elements so that the inner and outer toes are lined up stitch for stitch. A conventional Lintoe machine is then used to join the sock layers with a flat seam.

The sock of the invention is manufactured complete in a single process and incorporates a flat seam joining the two layers of fabric. This guarantees wale stitch to wale stitch alignment of both sock layers making up the final double sock which in turn gives perfect alignment of the double structure. Single process manufacture in a programmed, uninterrupted production cycle without manual intervention and requiring no hand finishing results in a level of precision and consistency in the dimensions and finish of the double layer sock of the invention unachievable in the manufacture of conventional double layer socks, making it ideally suited for preventive care applications.

The single process manufacture of the double sock of the invention allows the knitting the inner sock in single, unplated low friction yarn comprised of a blend of PTFE fibre which has the lowest coefficient of friction of all known fibers and a conventional fiber (an example of a PTFE blend is Dupont's Teflon SY yarn, comprised of 50% PTFE and 50% dacron fibre). The fabric construction to the inner layer is single 1×1 stitch, given a very flat, even surface profile. This combination gives the sock what is believed to be a lower coefficient of friction than socks made of conventional yarns at both the sock to foot interface and at the inner to outer sock interface (socks of same construction, i.e. terry cushion to the inner surface of the outer sock) without the full slippiness to the sock to foot interface, characteristic of an interface made with 100% PTFE fibre. This is desirable for most preventive care applications, particularly diabetes.

The PTFE blend is hydrophobic so that any moisture will pass through the thin inner PTFE blend layer into the outer layer which can have a hydrophilic yarn as the main fibre in its composition. PTFE blend has heat resistant and heat transfer properties which keeps the foot to sock interface cooler than other conventional yarns. PTFE is also chemically inert, making it a very stable medium to have at the contact point with skin.

Apart from the reduction in pressure to the foot, the terry cushion will improve the thermal insulation of the sock over single layer products. The extremely light and thin but very strong inner sock layer means that the overall bulk and weight of the complete double sock is only marginally heavier than many single layer sock products with terry fabric in the foot and therefore is comfortable to wear in either normal or orthotically modified shoes.

Thus, the invention provides a sock which combines a very thin, low friction inner layer with terry cushion padding to the foot in the outer layer, finished with a flat seam. The invention significantly reduces both friction and pressure at the interface to the foot, wicks moisture away and helps keep the skin surface cool. It can therefore help reduce and prevent callus and blister formation and other types of skin breakdown and is ideally suited for use by people with diabetes and other medical conditions which place them at risk of serious foot complications.

In the double layer structure of the invention, a PTFE blend yarn is incorporated into a single knit fabric on the inner sock while terry cushion in a conventional yarn is incorporated into the foot area in the outer layer.

It will be appreciated that the sock yarn may be varied according to the intended use. For example, there may be one sock suitable for mild/warm weather conditions and another sock more suited for colder weather wear.

The warm weather outer sock will most likely be comprised of about 85% cotton and plated with a 13% Nylon, 2% Lycra composite yarn. The inner sock is 100% PTFE blend with trace percentages of both Nylon and Nylon/Lycra composite yarns in the toe seam.

The winter version will have a yarn with better thermal insulation properties replacing cotton or equivalent as the main yarn. This yarn will most likely be Coolmax, wool or a wool variant such as Smartwool which does not shrink. Otherwise, the composition will approximate the warm weather sock. The specification of the composite Nylon/Lycra plating yarn may vary to suit the properties and knitting characteristics of the main outer sock yarn. It is likely that the main outer yarns in both variants will be treated with anti bacterial and anti fungal agents. It is also possible that composite main yarns will be used in which a treated fiber would be core spun with the main fiber.

The sock may incorporate a silver coated Nylon fiber as sold under the Trade Mark X-static by Noble Medical Technologies of the US. The fiber has a layer of silver permanently bonded to a Nylon fiber substrate without adversely affecting the performance characteristics of the Nylon. The silver coated fiber is effective as an anti-microbial agent and is useful in eliminating body odour and minimising static. The fiber also helps to regulate the temperature of the body surface in close proximity or contact with it.

It will be appreciated that the double layer structure can be varied according to the intended use. For example there may be a variant with the outer layer made in flat knit fabric, giving a very thin double layer sock suitable for wear with dress footwear. Such a sock will provide less pressure reduction than the main variant which has terry fabric in the foot area of the outer layer.

As an alternative to the method described in the examples, the sock may be knit as described up to the point when the machine has completed knitting the outer toe portion and discharged the dial loops back onto the cylinder needles. After this stage the sock may be completed as follows. After completing the above the sock continues to knit one course of fabric in the same yarn as used in the outer toe. The stitch length of this course is adjusted so that it is considerably bigger than the previously knitted course. This it to define an area for the linking operator to use when attaching (by hand) these loops wale for wale on the linking points of the linking machine. When this course has finished knitting, the knitting machine continues to knit with the same yarn and with the same stitch length as used previously to the linking course. A number of courses are knitted before the sock is pressed off from the knitting elements and discharged through the center of the cylinder and out of the solis hood. The machine then continues to knit a new article.

Part or all of each fabric layer in a layered sock of the invention can be constructed or structured to provide a constrictive effect to all or part of the foot or a non constrictive or relaxed effect to all or part of the foot. In most preventative care applications, particularly diabetes, a non constrictive characteristic is an important feature. With conventional layer socks where each fabric layer has the weight and bulk of a typical single layered sock, the combination of the layers has the effect of making the sock too constrictive for most preventative care applications Teflon and Dacron are Registered Trade Marks of Du Pont.

The invention is not limited to the embodiments hereinbefore described.

The invention claimed is:

1. A knitted sock comprising:

an inner sock layer comprising a reciprocated heel portion, a toe portion and a sole portion and the heel portion, toe portion and sole portion are of the same yarn composition, the inner sock layer having an inner toe end;

an outer sock layer having an outer toe end;

the inner toe end and the outer toe end being interconnected by at least one joining course to form a single composite toe end;

sections of said joining course of the single composite toe end being sewn together to provide a substantially flat toe seam.

2. The sock as claimed in claim 1 wherein the outer sock layer comprises a heel portion, a toe portion and a sole portion.

3. The sock as claimed in claim 2 wherein the outer sock layer comprises a reciprocated heel portion.

4. The sock as claimed in claim 2 wherein the heel portion, toe portion and sole portion of the outer sock layer is of a different yarn composition to the yarn composition of the heel portion, toe portion and sole portion of the inner sock layer.

5. The sock as claimed in claim 1 wherein the inner toe end and the outer toe end are joined by substantially stitch for stitch.

6. The sock as claimed in claim 1 wherein the joining course comprises a knitting yarn.

7. The sock as claimed in claim 6 wherein the knitting yarn is a polyamide yarn.

8. The sock as claimed in claim 6 wherein the knitting yarn is a Nylon yarn.

9. The sock as claimed in claim 1 wherein there are a number of joining courses.

10. The sock as claimed in claim 1 wherein the yarn of the composite toe end is the same as that of the outer toe.

11. The sock as claimed in claim 9 wherein there are at least two joining courses.

12. The sock as claimed in claim 1 wherein the sections of said joining course of the single composite toe end are joined substantially stitch for stitch.

13. The sock as claimed in claim 12 wherein sections of said joining course of the single composite toe end are knit together by a knitting yarn.

14. The sock as claimed in claim 13 wherein the knitting yarn is a polyamide yarn.

15. The sock as claimed in claim 13 wherein the knitting yarn is a Nylon yarn.

16. The sock as claimed in claim 1 wherein the toe seam is recessed with respect to the main body of the sock.

17. The sock as claimed in claim 1 wherein the toe seam has a thickness that is less than the thickness of main body of the sock adjacent the seam.

18. The sock as claimed in claim 1 wherein the sock is a two layer sock comprising the inner sock layer and the outer sock layer, the inner and outer sock layers having welt ends, and the welt ends are contiguous.

19. The sock as claimed in claim 1 wherein at least a portion of the inner sock layer is at least partially knit from at least one technical yarn.

20. The sock as claimed in claim 19 wherein a technical yarn is unplated.

21. The sock as claimed in claim 19 wherein a technical yarn is plated.

22. The sock as claimed in claim 21 wherein a technical yarn is plated with another technical yarn.

23. The sock as claimed in claim 19 wherein a technical yarn comprises a blend of fibers.

24. The sock as claimed in claim 19 wherein a technical yarn is corespun with an elastomeric yarn.

25. The sock as claimed in claim 19 wherein a technical yarn has low friction properties.

26. The sock as claimed in claim 19 wherein a technical yarn has antibacterial properties.

27. The sock as claimed in claim 19 wherein a technical yarn has antifungal properties.

28. The sock as claimed in claims 19 wherein a technical yarn comprises a low friction fiber.

29. The sock as claimed in claim 28 wherein the low friction fiber comprises a fluropolymeric fiber.

30. The sock as claimed in claim 28 wherein the low friction fiber comprises a polytetrafluroethylene fiber.

31. The sock as claimed in claim 19 wherein a technical yarn is a composite yarn comprising a first fiber having a low coefficient of friction and a second fiber having a higher coefficient of friction than that of the first fiber.

32. The sock as claimed in claim 31 wherein the first fiber comprises a fluropolymeric fiber.

33. The sock as claimed in claim 31 wherein the first fiber comprises a polytetrafluroethylene fiber.

34. The sock as claimed in claim 31 wherein the second fiber is a polyester fiber.

35. The sock as claimed in claim 31 wherein the second fiber is a polypropylene fiber.

36. The sock as claimed in claim 31 wherein the second fiber is a polyamide fiber.

37. The sock as claimed in claim 19 wherein a technical yarn comprises a blend of a polytetraflouroethylene fiber and a polyester fiber.

38. The sock as claimed in claim 19 wherein a technical yarn comprises coated Nylon fiber.

39. The sock as claimed in claim 38 wherein the Nylon fiber is coated with silver.

40. The sock as claimed in claim 19 wherein the portion of the inner sock layer which is at least partially knit from at least one technical yarn is one or more of an ankle portion, a heel portion, a sole portion and a toe portion.

41. The sock as claimed in claim 19 wherein the portion of the inner sock layer which is at least partially knit from at least one technical yarn comprises an ankle portion, a heel portion, a sole portion, and a toe portion.

42. The sock as claimed in claim 19 wherein a technical yarn is of a hydrophobic material.

43. The sock as claimed in claim 1 wherein the inner layer comprises a leg portion.

44. The sock as claimed in claim 43 wherein the leg portion of the inner layer is of an unrestrictive construction.

45. The sock as claimed in claim 43 wherein the leg portion of the inner layer is of a polyamide fiber.

46. The sock as claimed in claim 43 wherein the leg portion of the inner layer is of a Nylon fiber.

47. The sock as claimed in claim 1 wherein the outer layer comprises a foot portion and a leg portion.

48. The sock as claimed in claim 47 wherein at least the foot portion of the outer layer is of a cushion structure.

49. The sock as claimed in claim 48 wherein at least the foot portion of the outer layer is of a terry structure.

50. The sock as claimed in claim 47 wherein at least the foot portion of the outer layer is of a hydrophilic material.

51. The sock as claimed in claim 47 wherein the leg portion of the outer layer is of relaxed construction.

52. The sock as claimed in claim 47 wherein the leg portion of the outer layer is of restrictive construction.

53. The sock as claimed in claim 47 wherein at least portion of the outer layer of the sock comprises a technical yarn.

54. The sock as claimed in claim 53 wherein a technical yarn is a fiber having antifungal and/or antibacterial properties.

55. The sock as claimed in claim 54 wherein the fiber is a coated Nylon.

56. The sock as claimed in claim 55 wherein the Nylon is coated with silver.

* * * * *